US009563152B2

(12) United States Patent
Motegi

(10) Patent No.: US 9,563,152 B2
(45) Date of Patent: Feb. 7, 2017

(54) IMAGE FORMING APPARATUS

(71) Applicant: FUJI XEROX CO., LTD., Tokyo (JP)

(72) Inventor: Yuma Motegi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/921,451

(22) Filed: Oct. 23, 2015

(65) Prior Publication Data

US 2016/0327888 A1 Nov. 10, 2016

(30) Foreign Application Priority Data

May 7, 2015 (JP) ..... 2015-094726

(51) Int. Cl.
*G03G 15/16* (2006.01)

(52) U.S. Cl.
CPC ..... *G03G 15/1615* (2013.01); *G03G 15/1605* (2013.01); *G03G 2215/0174* (2013.01)

(58) Field of Classification Search
CPC ..... G03G 15/1605; G03G 2215/0167; G03G 2215/0174; G03G 2215/0177
See application file for complete search history.

(56) References Cited

U.S. PATENT DOCUMENTS 8,977,148 B2 3/2015 Kaneko et al.
2005/0100355 A1* 5/2005 Suzuki ..... G03G 13/01 399/27

FOREIGN PATENT DOCUMENTS

JP 2000-098675 A 4/2000
JP 2008-015269 A 1/2008
JP 2013-190679 A 9/2013

* cited by examiner

*Primary Examiner* — Erika J Villaluna
(74) *Attorney, Agent, or Firm* — Oliff PLC

(57) ABSTRACT

An image forming apparatus includes first and second rotating members, a setting unit, and first and second image forming units. The first rotating member rotates at a first period T1. The second rotating member rotates at a second period T2. The setting unit sets the first period T1 and the second period T2 so that T1 and T2 meet a relation T2=(n+0.5)×T1 (n is a positive integer). The first image forming unit forms a first image on the second rotating member in an x-th rotation (x is a positive integer) using first data obtained from print data and using the first rotating member. The second image forming unit forms a second image on the second rotating member in an (x+y)-th rotation (y is an odd positive integer) using second data obtained from the print data and using the first rotating member.

4 Claims, 11 Drawing Sheets

IMAGE FORMING APPARATUS

CROSS-REFERENCE TO RELATED APPLICATIONS

This application is based on and claims priority under 35 USC 119 from Japanese Patent Application No. 2015-094726 filed May 7, 2015.

BACKGROUND

Technical Field

The present invention relates to an image forming apparatus.

SUMMARY

According to an aspect of the present invention, there is provided an image forming apparatus including: a first rotating member that rotates at a first period T1; a second rotating member that rotates at a second period T2; a setting unit that sets the first period T1 and the second period T2 so that the first period T1 and the second period T2 meet a relation T2=(n+0.5)×T1 (n is a positive integer); a first image forming unit that forms a first image on the second rotating member in an x-th rotation (x is a positive integer) using first data obtained from print data and using the first rotating member; and a second image forming unit that forms a second image on the second rotating member in an (x+y)-th rotation (y is an odd positive integer) using second data obtained from the print data and using the first rotating member.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described in detail below with reference to the accompanying drawings.

First Exemplary Embodiment

Figure 1:
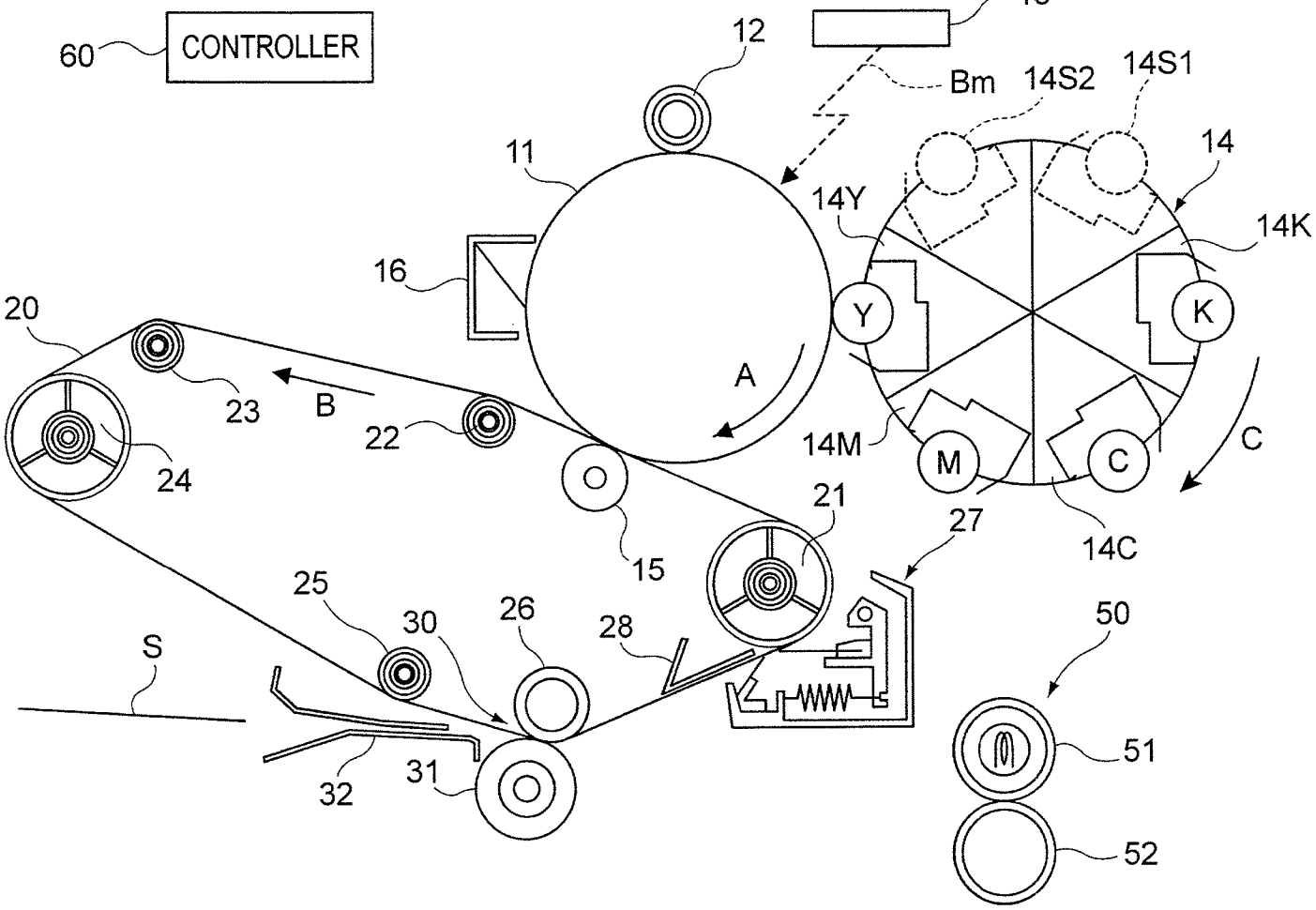
FIG. 1 illustrates a schematic configuration of an image forming apparatus according to a first exemplary embodiment.

FIG. 1 illustrates a schematic configuration of an image forming apparatus according to a first exemplary embodiment.

The image forming apparatus includes a photosensitive drum 11 and an intermediate transfer belt 20. The photosensitive drum 11 is disposed so as to be rotatable in the A direction. The intermediate transfer belt 20 is disposed so as to be rotatable in the B direction. Toner images in various colors, which have been formed on the photosensitive drum 11, are sequentially transferred (first transfer) to the intermediate transfer belt 20 to be held thereon. The image forming apparatus also includes a second transfer portion 30 and a fixing device 50. The second transfer portion 30 collectively transfers (second transfer) a superposed toner image, which has been transferred onto the intermediate transfer belt 20, to a sheet S. The fixing device 50 fixes the image, which has been transferred through the second transfer, onto the sheet S. The image forming apparatus further includes a controller 60 that controls various mechanism portions of the image forming apparatus. The A direction which is the rotational direction of the photosensitive drum 11 and the B direction which is the rotational direction of the intermediate transfer belt 20 are the same direction in a region (first transfer region to be discussed later) in which the photosensitive drum 11 and the intermediate transfer belt 20 face each other.

A charging roller 12, an exposure device 13, a rotary developing device 14, a first transfer roller 15, and a drum cleaning device 16 are disposed around the photosensitive drum 11, sequentially along the A direction. The charging roller 12 charges the photosensitive drum 11. The exposure device 13 exposes the charged photosensitive drum 11 to light (in the drawing, an exposure beam is indicated by symbol Bm). Developing sections 14Y, 14M, 14C, and 14K that store a toner for various color components, namely yellow (Y), magenta (M), cyan (C), and black (K), and that turn an electrostatic latent image on the photosensitive drum 11 into a visible image using the toner are rotatably attached to the rotary developing device 14. The first transfer roller 15 transfers the toner images for the various color components formed on the photosensitive drum 11 to the intermediate transfer belt 20. The drum cleaning device 16 cleans a residual toner on the photosensitive drum 11. The region in which the photosensitive drum 11 and the first transfer roller 15 face each other across the intermediate transfer belt 20 is referred to as a first transfer region. In the exemplary embodiment, the charging roller 12 and the exposure device 13 function as a latent image forming unit. In addition, the first transfer roller 15 functions as a transfer unit.

The charging roller 12 is disposed in contact with the photosensitive drum 11, and rotated along with rotation of the photosensitive drum 11. The first transfer roller 15 is disposed in contact with the intermediate transfer belt 20 in the first transfer region in which the first transfer roller 15 faces the photosensitive drum 11 across the intermediate transfer belt 20, and rotated along with rotation of the intermediate transfer belt 20. The drum cleaning device 16 includes a blade member that contacts the photosensitive drum 11, for example.

The photosensitive drum 11, which serves as an example of a photosensitive drum, is configured by forming an organic photosensitive layer on the surface of a thin-walled cylindrical drum made of metal. In the example, the organic photosensitive layer is constituted of a material that is charged to a negative polarity. The photosensitive drum 11 is grounded.

The rotary developing device 14 is rotatable in the C direction, and configured such that a total of six developing sections are mountable thereon. It should be noted, however, that in the example, four developing sections 14Y, 14M, 14C, and 14K are mounted on the rotary developing device 14 successively in the circumferential direction with the two remaining spaces left vacant. The developing sections 14Y, 14M, 14C, and 14K, which each serve as an example of a developing unit, perform development using a reversal development method. Thus, the toner used by the developing sections 14Y, 14M, 14C, and 14K has a negative charging polarity. In the following description, the developing sections composing the rotary developing device 14 will be referred to as a yellow developing section 14Y, a magenta developing section 14M, a cyan developing section 14C, and a black developing section 14K. In the following description, in addition, a vacant space that is adjacent to the black developing section 14K will be referred to as a first vacant space 14S1, and a vacant space that is adjacent to the first vacant space 14S1 will be referred to as a second vacant space 14S2. A portion of the rotary developing device 14 that faces the photosensitive drum 11 is referred to as a developing position.

In the exemplary embodiment, the photosensitive drum 11, the charging roller 12, the exposure device 13, the rotary developing device 14, and the first transfer roller 15 function as a first image forming unit, a second image forming unit, and an image forming unit.

The intermediate transfer belt 20 which serves as an example of a second rotating member, a transfer element, and an identical medium is wound around plural (in the exemplary embodiment, six) rollers 21 to 26. Among such rollers, the rollers 21 and 25 are driven rollers. The roller 22 is an idle roller made of metal and used to position the intermediate transfer belt 20 and form a flat first transfer surface. The roller 23 is a tension roller used to make the tension of the intermediate transfer belt 20 constant. The roller 24 is a driving roller for the intermediate transfer belt 20. The roller 26 is a back-up roller for a second transfer to be discussed later.

The second transfer portion 30 is composed of a second transfer roller 31, the back-up roller 26, and so forth. The second transfer roller 31 is disposed on the side of a toner image holding surface of the intermediate transfer belt 20. A paper transport guide 32 that guides a transported sheet S to the second transfer portion 30 is attached upstream of the second transfer portion 30. The region in which the second transfer roller 31 and the back-up roller 26 face each other across the intermediate transfer belt 20 is referred to as a second transfer region.

A belt cleaning device 27 that cleans the residual toner adhering onto the intermediate transfer belt 20 after the second transfer is provided downstream of the second transfer portion 30. A sheet metal member 28 is disposed at a position facing the belt cleaning device 27 across the intermediate transfer belt 20 to extend along the inner surface of the intermediate transfer belt 20.

In the exemplary embodiment, in the case where a color image including toner images in plural colors is to be formed on the sheet S, the second transfer roller 31 and the belt cleaning device 27 are located away from the intermediate transfer belt 20 until the toner image before the final color passes through the second transfer roller 31 and the belt cleaning device 27. The second transfer roller 31 is rotated along with rotation of the intermediate transfer belt 20 when the second transfer roller 31 contacts the intermediate transfer belt 20.

The fixing device 50 includes a heating roller 51 and a pressurizing roller 52. The heating roller 51 includes a heating source such as a halogen lamp built therein. The pressurizing roller 52 is disposed in press contact with the heating roller 51. In the fixing device 50, the sheet S to which the toner image has been transferred is passed through a fixing nip region formed between the heating roller 51 and the pressurizing roller 52 to perform fixation.

Next, the configuration of the developing sections mounted on the rotary developing device 14 will be described using the yellow developing section 14Y as an example. The magenta developing section 14M, the cyan developing section 14C, and the black developing section 14K are the same in configuration as the yellow developing section 14Y except for the color of the toner housed therein.

Figure 2:
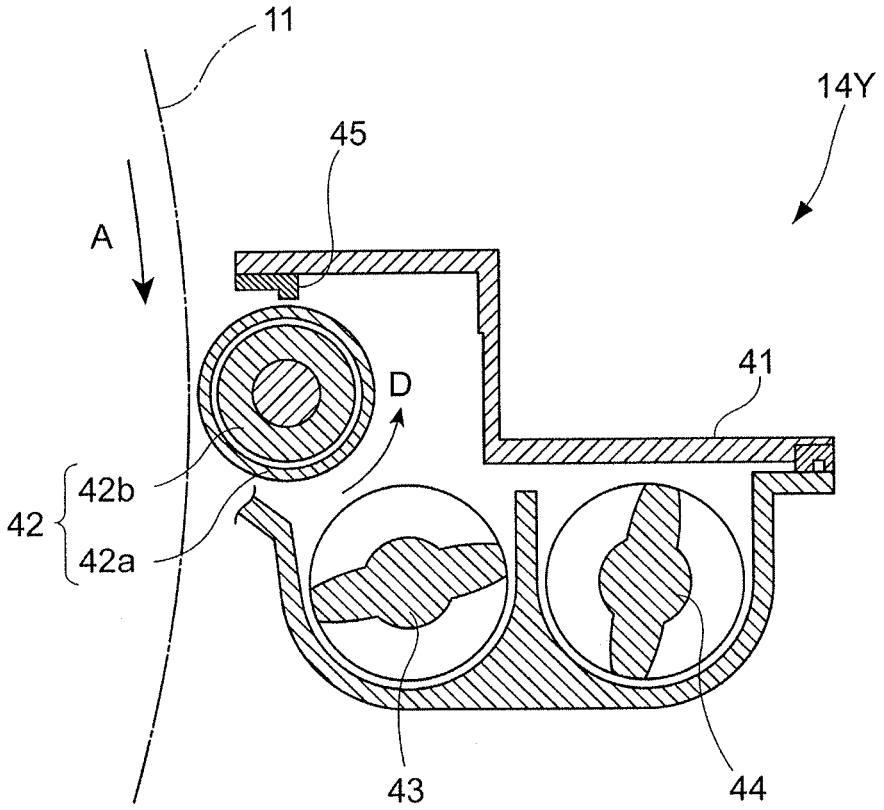
FIG. 2 is a sectional view illustrating an example of the configuration of a yellow developing section.

FIG. 2 is a sectional view illustrating an example of the configuration of the yellow developing section 14Y. FIG. 2 illustrates a case where the yellow developing section 14Y is disposed at the developing position at which the yellow developing section 14K faces the photosensitive drum 11.

The yellow developing section 14Y includes a developing housing 41 and a developing roller 42. The developing housing 41 includes an opening formed to face the outer peripheral surface of the photosensitive drum 11, and stores a developer (not illustrated) containing a carrier and a toner. The developing roller 42 is rotatably disposed at a location facing the opening of the developing housing 41. The developing roller 42 is disposed in no contact with the photosensitive drum 11.

A first agitation/transport member 43 and a second agitation/transport member 44 are provided inside the developing housing 41, and beyond and below the developing roller 42 as seen from the photosensitive drum 11. The first agitation/transport member 43 and the second agitation/transport member 44 are disposed to extend along the axial direction of the photosensitive drum 11. A partition wall for separation between the first agitation/transport member 43 and the second agitation/transport member 44 is provided between the first agitation/transport member 43 and the second agitation/transport member 44. The partition wall is formed integrally with the developing housing 41. The partition wall is not provided at both ends, in the axial direction, of the first agitation/transport member 43 and the second agitation/transport member 44 so that the developer is circulated and transported in the developing housing 41 by the first agitation/transport member 43 and the second agitation/transport member 44. A layer thickness restricting member 45 is provided above the developing roller 42 in the drawing. The layer thickness restricting member 45 is attached to the developing housing 41 to restrict the thickness of a layer of the developer adhering to the developing roller 42.

In the yellow developing section 14Y, a so-called two-component developer containing a toner colored yellow and a carrier having magnetic properties is used as the developer. In the developer, the carrier has a positive charging polarity, and the toner has a negative charging polarity as discussed above.

The developing roller 42 includes a developing sleeve 42*a* and a magnet roller 42*b*. The developing sleeve 42*a* is hollow, and rotatably disposed. The magnet roller 42*b* is disposed inside the developing sleeve 42*a*, and attached as fixed to the developing housing 41. Plural magnetic poles (not illustrated) are arranged inside the magnet roller 42*b*. The developing sleeve 42*a*, which serves as an example of a first rotating member, a developer holding element, and a rotating member, is rotated in the D direction in image forming operation in which an image is formed on the sheet S. Thus, in the image forming operation, the photosensitive drum 11 which is rotated in the A direction and the developing sleeve 42*a* which is rotated in the D direction are moved in the same direction in a developing region in which the photosensitive drum 11 and the developing sleeve 42*a* face each other.

Figure 3:
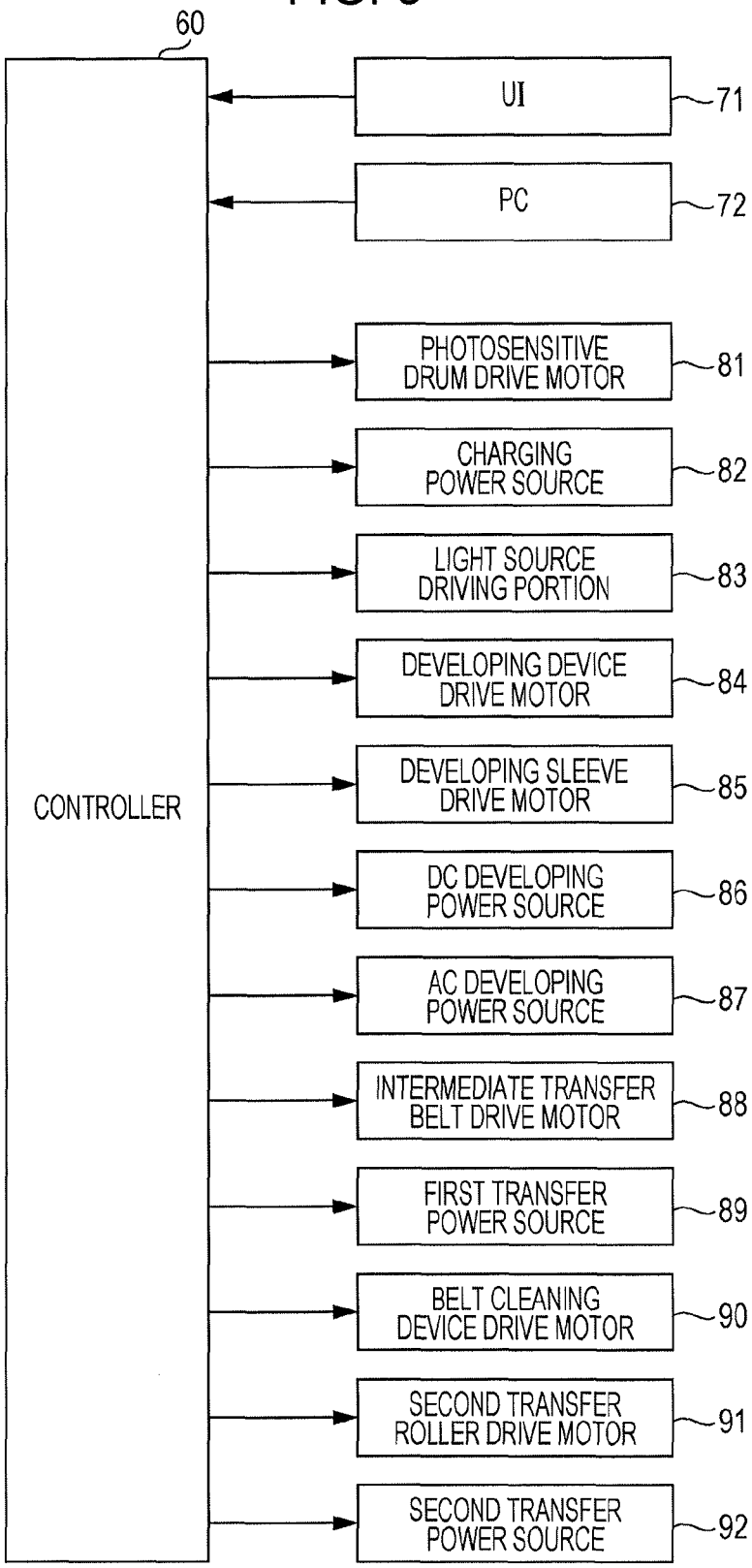
FIG. 3 illustrates an example of the configuration of a control system for the image forming apparatus.

FIG. 3 illustrates an example of the configuration of a control system for the image forming apparatus according to the exemplary embodiment.

An instruction received from a user is input from a user interface (UI) 71 and a personal computer (PC) 72 to the controller 60, which serves as an example of a setting unit, a preparation unit, a distribution unit, and a control unit.

The controller 60 outputs a control signal to each of a photosensitive drum drive motor 81, a charging power source 82, and a light source driving portion 83. The photosensitive drum drive motor 81 drives the photosensitive drum 11 for rotation. The charging power source 82 supplies a charging bias to the charging roller 12. The light source driving portion 83 drives a light source (not illustrated) provided to the exposure device 13. The controller 60 also outputs a control signal to each of a developing device drive motor 84 and a developing sleeve drive motor 85. The developing device drive motor 84 drives the rotary developing device 14 for rotation. The developing sleeve drive motor 85 drives the developing sleeve 42*a* provided to the developing section positioned at the developing position for rotation. The controller 60 further supplies a control signal to each of a direct-current (DC) developing power source 86 and an alternating-current (AC) developing power source 87. The DC developing power source 86 supplies a direct-current (DC) developing bias to the developing sleeve 42*a* provided to the developing section positioned at the developing position. The AC developing power source 87 supplies an alternating-current (AC) developing bias to the developing sleeve 42*a* provided to the developing section positioned at the developing position. Furthermore, the controller 60 outputs a control signal to each of an intermediate transfer belt drive motor 88, a first transfer power source 89, and a belt cleaning device drive motor 90. The intermediate transfer belt drive motor 88 drives the intermediate transfer belt 20 via the driving roller 24 for rotation. The first transfer power source 89 supplies a first transfer bias to the first transfer roller 15. The belt cleaning device drive motor 90 advances and retracts the belt cleaning device 27 to and from the intermediate transfer belt 20. The controller 60 additionally outputs a control signal to each of a second transfer roller drive motor 91 and a second transfer power source 92. The second transfer roller drive motor 91 advances and retracts the second transfer roller 31 to and from the intermediate transfer belt 20. The second transfer power source 92 supplies a second transfer bias between the second transfer roller 31 and the back-up roller 26. Although not illustrated, the controller 60 also outputs a control signal to the fixing device 50 and a supply system for the sheet S.

In the image forming apparatus according to the exemplary embodiment, the peripheral speed ratio between the photosensitive drum 11 and the intermediate transfer belt 20 during the image forming operation is set to 1:1. In addition, the peripheral speed ratio between the photosensitive drum 11 and the developing roller 42 (developing sleeve 42*a*) during the image forming operation is set to 1:1.7. Thus, the peripheral speed ratio between the photosensitive drum 11 and the developing roller 42 (developing sleeve 42*a*) during the image forming operation is set to 1:1.7.

Figure 4:
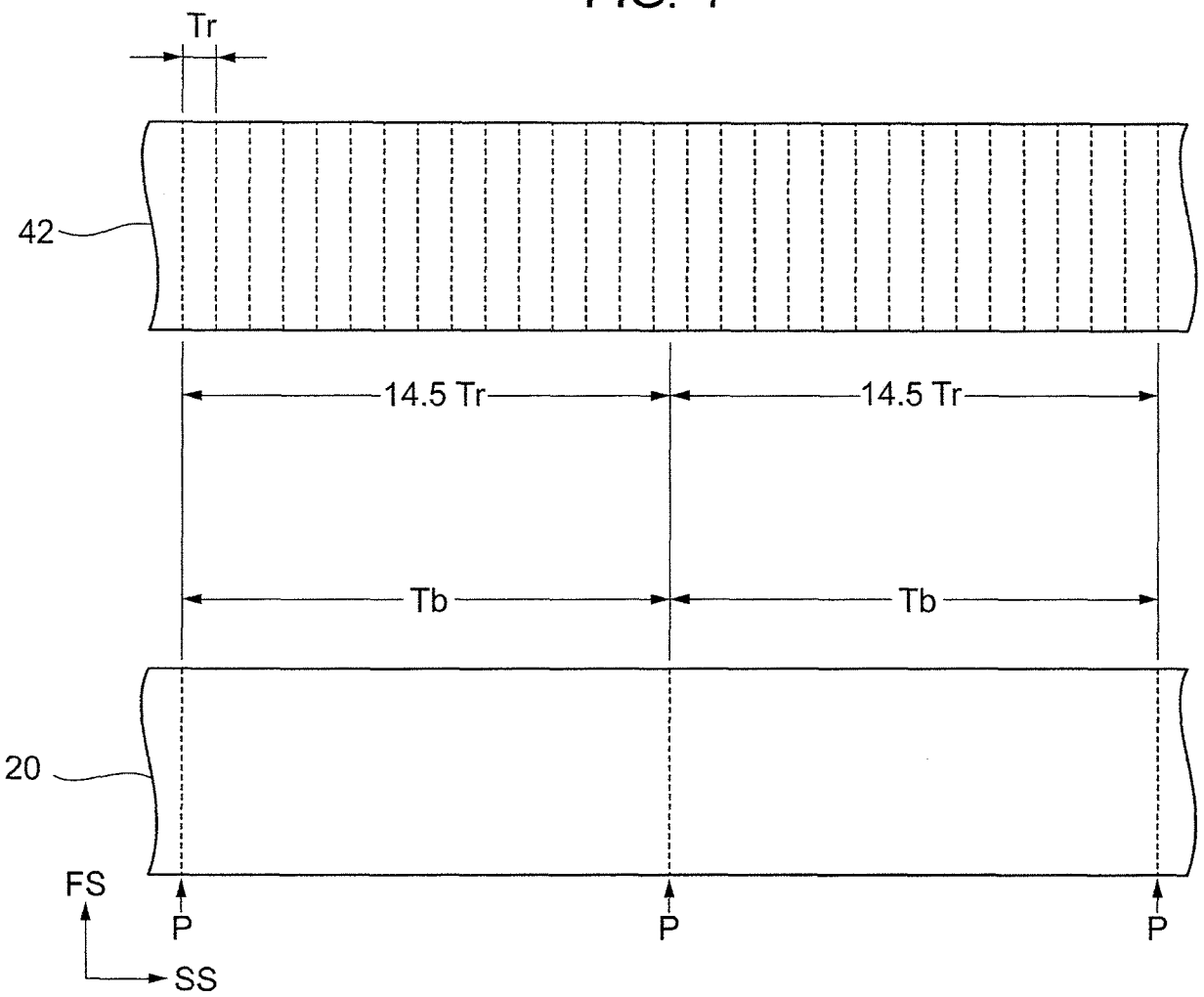
FIG. 4 illustrates the relationship between the rotational period of a developing roller and the rotational period of an intermediate transfer belt during image forming operation.

FIG. 4 illustrates the relationship between the rotational period of the developing roller 42 (developing sleeve 42*a*) and the rotational period of the intermediate transfer belt 20 during the image forming operation. In FIG. 4, the upper row indicates the rotational period of the developing roller 42, and the lower row indicates the rotational period of the intermediate transfer belt 20, together with a principal scanning direction FS and a sub scanning direction SS. In the following description, the rotational period of the developing roller 42 will be referred to as a roller rotation period Tr, and the rotational period of the intermediate transfer belt 20 will be referred to as a belt rotation period Tb. The roller rotation period Tr is an example of a first period T1. The belt rotation period Tb is an example of a second period T2. The start point of the belt rotation period Tb in the intermediate transfer belt 20, that is, the position as a reference of each plate in the image forming operation, is referred to as a plate reference position P.

In the image forming apparatus, the developing roller 42 makes 14.5 rotations while the intermediate transfer belt 20 makes one rotation (Tb=14.5 Tr). That is, in the image forming apparatus, the belt rotation period Tb and the roller rotation period Tr meet the relation $Tb=(n+0.5)\times Tr$ (n is a positive integer). The relation is determined in accordance with the peripheral length of the developing roller 42 (developing sleeve 42*a*), the peripheral length of the intermediate transfer belt 20, and the peripheral speed ratio between the developing roller 42 and the intermediate transfer belt 20.

Next, the image forming operation of the image forming apparatus will be described.

Figure 5:
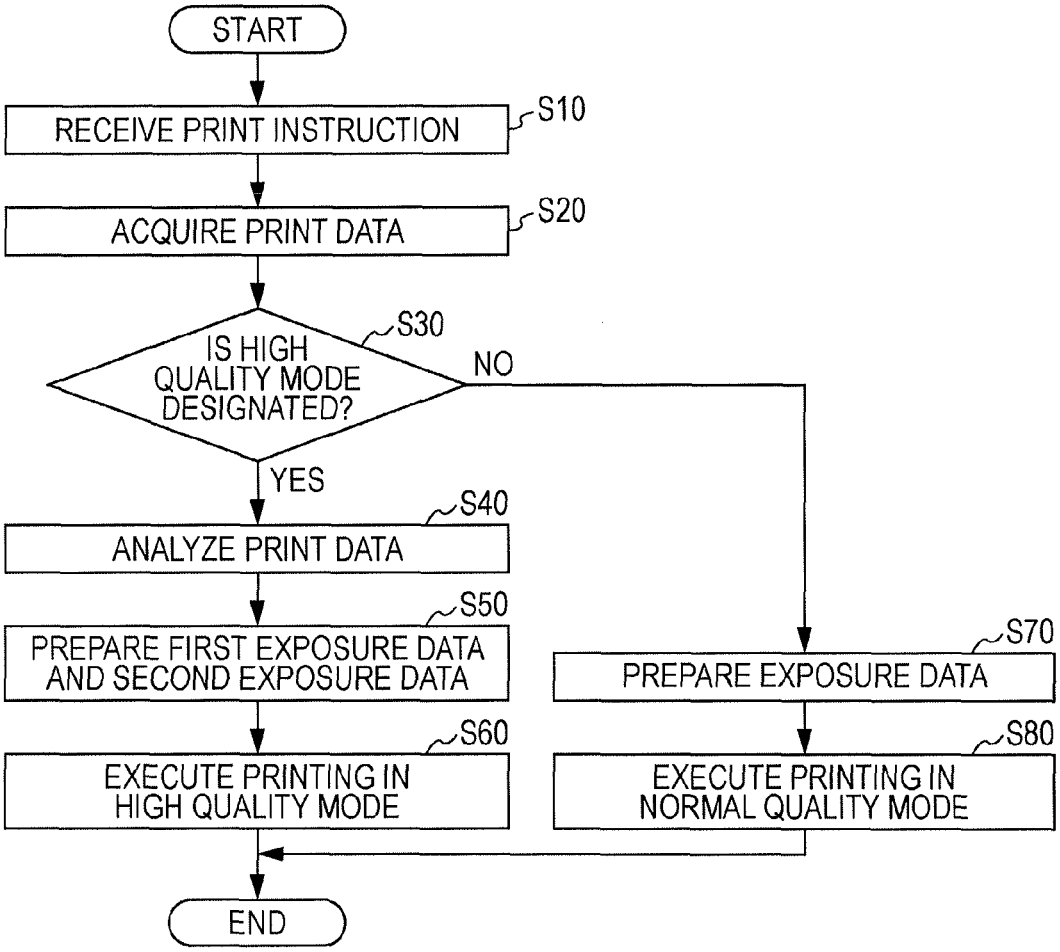
FIG. 5 is a flowchart illustrating the procedure for selecting an image quality mode.

FIG. 5 is a flowchart illustrating the procedure for selecting an image quality mode in the image forming operation.

First, the controller 60 receives a print instruction from the UI 71 or the PC 72 (step S10). Subsequently, the controller 60 acquires print data that accompany the print instruction received in step S10 (step S20). Further, the controller 60 determines whether or not a "high quality mode" is designated in the print instruction received in step S10 from the UI 71 or the PC 72 (step S30).

In the case where a positive determination (YES) is made in step S30, the controller 60 analyzes the print data acquired in step S20 (step S40). Then, the controller 60 prepares first exposure data and second exposure data, which are to be used by the exposure device 13 in the image forming operation, on the basis of the print data analysis result obtained in step S40 (step S50). Then, the controller 60 uses the first exposure data and the second exposure data prepared in step S50 to execute printing (image forming operation) in the high quality mode (step S60), and completes the sequence of processes.

In the case where a negative determination (NO) is made in step S30, on the other hand, the controller 60 prepares exposure data, which are to be used by the exposure device 13 in the image forming operation, on the basis of the print data acquired in step S20 (step S70). Then, the controller 60 uses the exposure data prepared in step S70 to execute printing (image forming operation) in a normal quality mode (step S80), and completes the sequence of processes.

Next, the image forming operation in each image quality mode discussed above will be specifically described. In the example, the image forming apparatus illustrated in FIG. 1 is used to form a full-color image with four colors including yellow, magenta, cyan, and black on a single sheet S.

Figure 6:
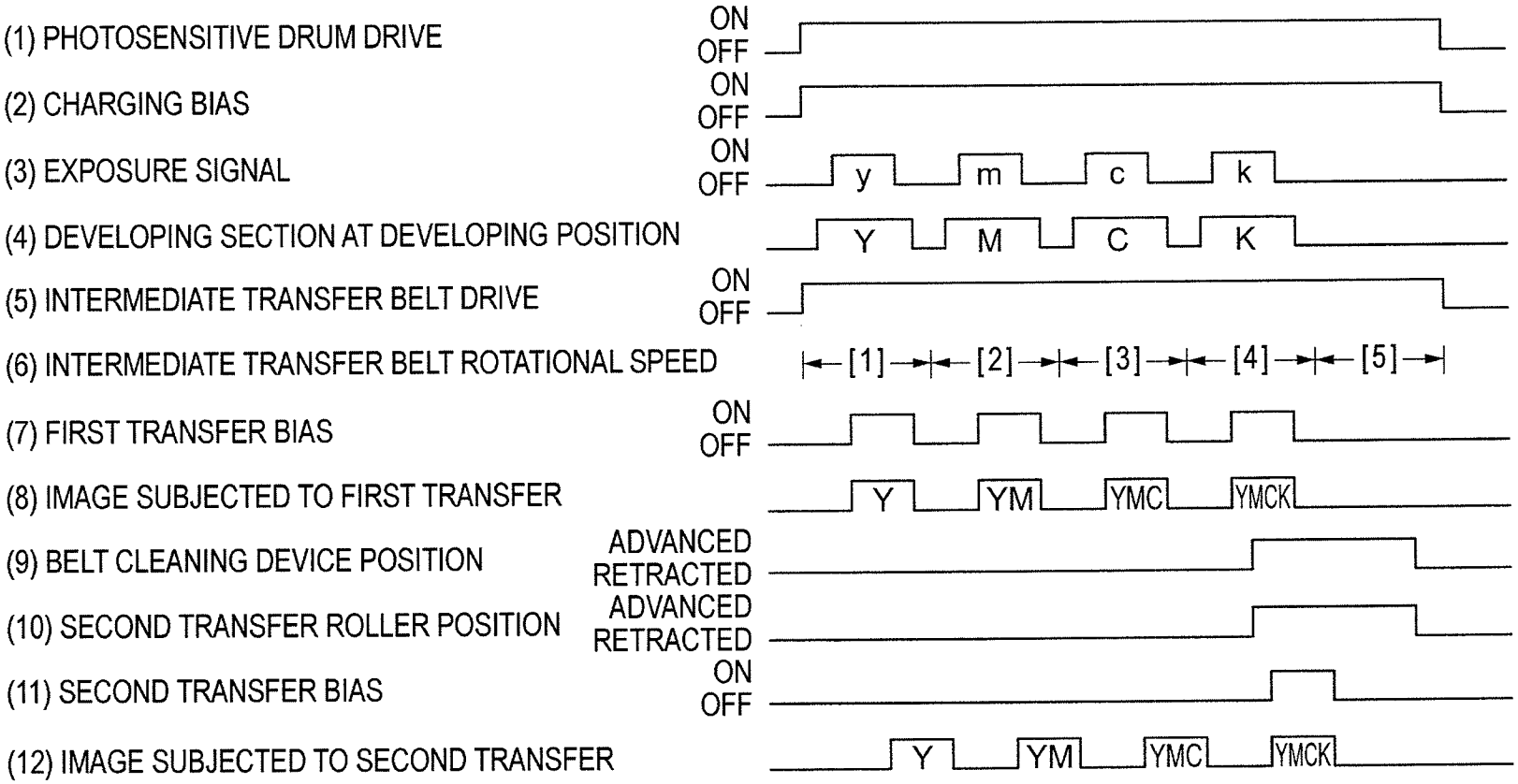
FIG. 6 is a timing chart illustrating the procedures of image forming operation in a normal quality mode.

FIG. 6 is a timing chart illustrating the procedures of the image forming operation in the normal quality mode. FIG. 6 illustrates the relationship between the lapse of time and rotational drive of the photosensitive drum 11 [(1) photosensitive drum drive], supply of a charging bias to the charging roller 12 [(2) charging bias], supply of an exposure signal to the exposure device 13 [(3) exposure signal], the developing section of the rotary developing device 14 disposed at the developing position [(4) developing section at developing position], rotational drive of the intermediate transfer belt 20 [(5) intermediate transfer belt drive], number of rotations of the intermediate transfer belt 20 [(6) intermediate transfer belt rotational speed], supply of a first transfer bias to the first transfer roller 15 [(7) first transfer bias], the image region on the intermediate transfer belt 20 passing through the first transfer region [(8) image subjected to first transfer], the position of the belt cleaning device 27 with respect to the intermediate transfer belt 20 [(9) belt cleaning device position], the position of the second transfer roller 31 with respect to the intermediate transfer belt 20 [(10) second transfer roller position], supply of a second transfer bias to the second transfer portion 30 [(11) second transfer bias], and the image region on the intermediate transfer belt 20 passing through the second transfer region [(12) image subjected to second transfer]. The same also applies to FIG. 7 to be discussed later.

In the initial state, the photosensitive drum drive, the charging bias, the exposure signal, the intermediate transfer belt drive, the first transfer bias, and the second transfer bias have been turned off (inactivated). At this time, the rotary developing device 14 has been set such that no developing section is disposed at the developing position. In the initial state, in addition, drive of the developing sleeve and the developing biases (DC and AC) have all been turned off. In the initial state, further, the belt cleaning device position and the second transfer roller position have been set to "retracted" so that the second transfer roller 31 and the belt cleaning device 27 are located away from the intermediate transfer belt 20. In the following description, the phrase "x-th rotation" (x is a positive integer) of the intermediate transfer belt 20 means the number of rotations of the intermediate transfer belt 20 with reference to the plate reference position P. The same also applies to FIG. 7 to be discussed later.

As the image forming operation in the normal quality mode is started, drive of the photosensitive drum 11 and the intermediate transfer belt 20 is started (OFF→ON). Consequently, the photosensitive drum 11 is rotated in the A direction, and the intermediate transfer belt 20 is rotated in the B direction. At this time, the intermediate transfer belt 20 is in the first rotation. As rotation of the photosensitive drum 11 is started, supply of a charging bias to the charging roller 12 is started (OFF→ON).

Subsequently, drive of the rotary developing device 14 is started, and stopped with the yellow developing section 14Y disposed at the developing position. After the yellow developing section 14Y is stopped at the developing position, supply of a yellow exposure signal y is started (OFF→ON). At this time, exposure data prepared for yellow, of the exposure data prepared in step S70 of FIG. 5, are supplied as the yellow exposure signal y. Consequently, the photosensitive drum 11, which is rotated in the A direction in the state of being charged to a charging potential, is exposed to the exposure beam Bm output from the exposure device 13 in a portion for formation of a yellow toner image to be charged from the charging potential to an exposure potential. As a result, a yellow electrostatic latent image is formed on the photosensitive drum 11, which has been charged and exposed to light, with a region at the charging potential constituting a background portion (unexposed portion) and with a region at the exposure potential constituting an image portion (exposed portion).

Then, as the photosensitive drum 11 is rotated in the A direction, the yellow electrostatic latent image formed on the photosensitive drum 11 passes through the developing region. At this time, a yellow toner is selectively transferred from the yellow developing section 14Y, which is disposed at the developing position, to the image portion, at the exposure potential, of the photosensitive drum 11. As a result, a yellow toner image that matches the yellow electrostatic latent image is developed on the photosensitive drum 11 which has passed through the developing region.

Next, as the distal end of the yellow toner image formed on the photosensitive drum 11 reaches the first transfer region, supply of a first transfer bias is started (OFF→ON). Consequently, the yellow toner image formed on the photosensitive drum 11 which is rotated in the A direction starts being transferred to the intermediate transfer belt 20, which is rotated in the B direction, through a first transfer.

In the example, after a first transfer of the yellow toner image is started, supply of the yellow exposure signal y is stopped (ON→OFF), and formation of the yellow electrostatic latent image is ended. Then, as the rear end of the yellow toner image formed on the photosensitive drum 11 passes through the first transfer region, supply of a first transfer bias is stopped (ON→OFF). Consequently, the entire region of the yellow toner image is transferred to the intermediate transfer belt 20, which is rotated in the B direction, through a first transfer. In the first transfer for yellow, the yellow toner remaining on the photosensitive drum 11 without being transferred to the intermediate transfer belt 20 reaches a portion facing the drum cleaning device 16 as the photosensitive drum 11 is rotated in the A direction, and is removed by the drum cleaning device 16. Then, the first rotation of the intermediate transfer belt 20 is ended, and the intermediate transfer belt 20 enters the second rotation.

After the yellow electrostatic latent image passes through the developing region, drive of the rotary developing device 14 is started, and stopped with the magenta developing section 14M disposed at the developing position. After the magenta developing section 14M is stopped at the developing position, supply of a magenta exposure signal m is started (OFF→ON). At this time, exposure data prepared for magenta, of the exposure data prepared in step S70 illustrated in FIG. 5, are supplied as the magenta exposure signal m. Consequently, the photosensitive drum 11, which is rotated in the A direction in the state of being charged, is exposed to the exposure beam Bm output from the exposure device 13 in a portion for formation of a magenta toner image. As a result, a magenta electrostatic latent image is formed on the photosensitive drum 11.

Then, as the photosensitive drum 11 is rotated in the A direction, the magenta electrostatic latent image formed on the photosensitive drum 11 passes through the developing region. At this time, a magenta toner is selectively transferred from the magenta developing section 14M, which is disposed at the developing position, to the photosensitive drum 11. As a result, a magenta toner image that matches the magenta electrostatic latent image is developed on the photosensitive drum 11 which has passed through the developing region.

Next, as the distal end of the magenta toner image formed on the photosensitive drum 11 reaches the first transfer region, supply of a first transfer bias is started (OFF→ON). Consequently, the magenta toner image formed on the photosensitive drum 11 which is rotated in the A direction starts being transferred to the intermediate transfer belt 20, which is rotated in the B direction, through a first transfer. In the exemplary embodiment, supply of the magenta exposure signal m is controlled such that the distal end of the magenta toner image formed on the photosensitive drum 11 reaches the first transfer region when the distal end of the yellow toner image which has already been transferred to the intermediate transfer belt 20 reaches the first transfer region. Therefore, the magenta toner image is superposed on the yellow toner image on the intermediate transfer belt 20 which has passed through the first transfer region.

In the example, after a first transfer of the magenta toner image is started, supply of the magenta exposure signal m is stopped (ON→OFF) to end formation of the magenta electrostatic latent image. Then, as the rear end of the magenta toner image formed on the photosensitive drum 11 passes through the first transfer region, supply of a first transfer bias is stopped (ON→OFF). Consequently, the entire region of the magenta toner image is transferred to the intermediate transfer belt 20, which is rotated in the B direction, through a first transfer, to form a superposed toner image of yellow and magenta. In the first transfer for magenta, the magenta toner remaining on the photosensitive drum 11 without being transferred to the intermediate transfer belt 20 reaches a portion facing the drum cleaning device 16 as the photosensitive drum 11 is rotated in the A direction, and is removed by the drum cleaning device 16. Then, the second rotation of the intermediate transfer belt 20 is ended, and the intermediate transfer belt 20 enters the third rotation.

After that, through the same procedures, a cyan toner image is formed on the intermediate transfer belt 20 in the third rotation (on the basis of a cyan exposure signal c), and a black toner image is formed on the intermediate transfer belt 20 in the fourth rotation (on the basis of a black exposure signal k). As a result, yellow, magenta, cyan, and black toner images are superposed on each other on the intermediate transfer belt 20.

After the black electrostatic latent image passes through the developing region, drive of the rotary developing device 14 is started, and stopped with none of the developing sections (14Y, 14M, 14C, and 14K) disposed at the developing position.

After the rear end of the superposed toner image of yellow, magenta, and cyan held on the intermediate transfer belt 20 which is rotated in the B direction passes through a portion facing the belt cleaning device 27, and before the distal end of a superposed toner image of yellow, magenta, cyan, and black, which is obtained by further superposing a black toner image on the superposed toner image through passage through the first transfer region thereafter, reaches the second transfer region, the second transfer roller 31 and the belt cleaning device 27 are moved (retracted→advanced) to a position at which the second transfer roller 31 and the belt cleaning device 27 contact the intermediate transfer belt 20. Then, as the distal end of the superposed toner image of yellow, magenta, cyan, and black held on the intermediate transfer belt 20 reaches the second transfer region, supply of a second transfer bias is started (OFF→ON). In the exemplary embodiment, transport of the sheet S is controlled such that the distal end of the sheet S reaches the second transfer region when the distal end of the superposed toner image of yellow, magenta, cyan, and black held on the intermediate transfer belt 20 reaches the second transfer region. Therefore, the superposed toner image is transferred from the intermediate transfer belt 20 to the sheet S through a second transfer in the second transfer region.

As the superposed toner image held on the intermediate transfer belt 20 and the sheet S pass through the second transfer region, supply of a second transfer bias is stopped (ON→OFF) to complete a second transfer of the superposed toner image to the sheet S. The superposed toner image on the sheet S which has passed through the second transfer region is fixed by the fixing device 50. In the second transfer of the superposed toner image, the toners in the various colors remaining on the intermediate transfer belt 20 without being transferred to the sheet S reaches a portion facing the belt cleaning device 27 as the intermediate transfer belt 20 is rotated in the B direction, and are removed by the drum cleaning device 27.

Then, after the rear end of the superposed toner image formation region on the intermediate transfer belt 20 passes through a portion facing the belt cleaning device 27, the second transfer roller 31 and the belt cleaning device 27 are moved (advanced→retracted) to a position away from the intermediate transfer belt 20. In addition, drive of the photosensitive drum 11 and the intermediate transfer belt 20 is stopped (ON→OFF), and supply of a charging bias is also stopped (ON→OFF).

Through the steps described above, formation of a full-color image on the single sheet S in the normal quality mode is completed.

In this way, in the normal quality mode according to the exemplary embodiment, the yellow toner image, the magenta toner image, the cyan toner image, and the black toner image are transferred to the intermediate transfer belt 20 in the first rotation, the second rotation, the third rotation, and the fourth rotation, respectively, of the intermediate transfer belt 20 through a first transfer. In the normal quality mode according to the exemplary embodiment, in addition, the superposed toner image on the intermediate transfer belt 20 is transferred to the sheet S through a second transfer in the fourth rotation of the intermediate transfer belt 20.

Figure 7:
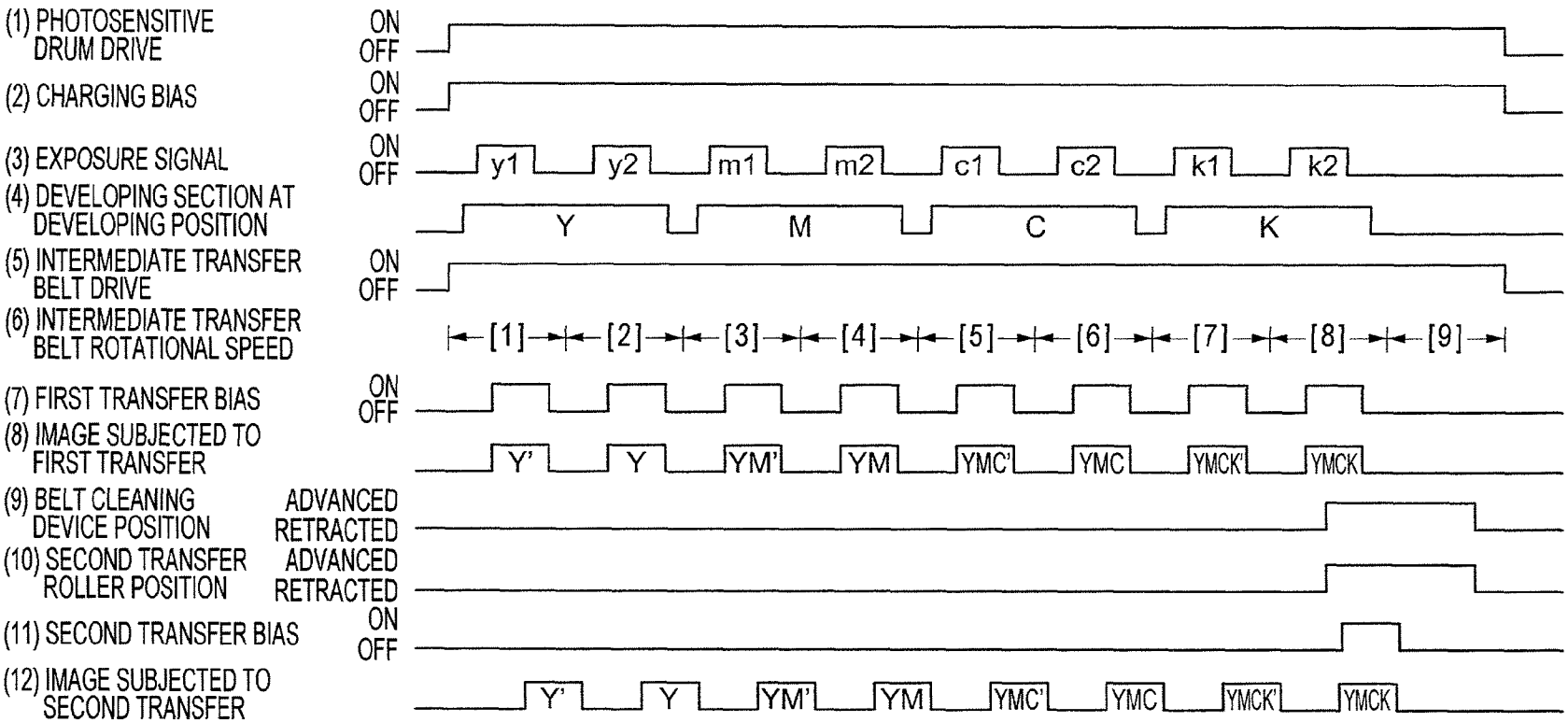
FIG. 7 is a timing chart illustrating the procedures of image forming operation in a high quality mode.

FIG. 7 is a timing chart illustrating the procedures of the image forming operation in the high quality mode.

As the image forming operation in the high quality mode is started, drive of the photosensitive drum 11 and the intermediate transfer belt 20 is started (OFF→ON). Consequently, the photosensitive drum 11 is rotated in the A direction, and the intermediate transfer belt 20 is rotated in the B direction. At this time, the intermediate transfer belt 20 is in the first rotation. As rotation of the photosensitive drum 11 is started, supply of a charging bias to the charging roller 12 is started (OFF→ON).

Subsequently, drive of the rotary developing device 14 is started, and stopped with the yellow developing section 14Y disposed at the developing position. After the yellow developing section 14Y is stopped at the developing position, supply of a first yellow exposure signal y1 is started (OFF→ON). At this time, exposure data prepared for yellow, of the first exposure data prepared in step S50 of FIG. 5, are supplied as the first yellow exposure signal y1. Consequently, the photosensitive drum 11, which is rotated in the A direction in the state of being charged, is exposed to the exposure beam Bm output from the exposure device 13 in a portion for formation of a first yellow toner image. As a result, a first yellow electrostatic latent image is formed on the photosensitive drum 11.

Then, as the photosensitive drum 11 is rotated in the A direction, the first yellow electrostatic latent image formed on the photosensitive drum 11 passes through the developing region. At this time, a yellow toner is selectively transferred from the yellow developing section 14Y, which is disposed at the developing position, to the photosensitive drum 11. As a result, a first yellow toner image that matches the first yellow electrostatic latent image is developed on the photosensitive drum 11 which has passed through the developing region.

Next, as the distal end of the first yellow toner image formed on the photosensitive drum 11 reaches the first transfer region, supply of a first transfer bias is started (OFF→ON). Consequently, the first yellow toner image formed on the photosensitive drum 11 which is rotated in the A direction starts being transferred to the intermediate transfer belt 20, which is rotated in the B direction, through a first transfer.

In the example, after a first transfer of the first yellow toner image is started, supply of the first yellow exposure signal y1 is stopped (ON→OFF), and formation of the first yellow electrostatic latent image is ended. Then, as the rear end of the first yellow toner image formed on the photosensitive drum 11 passes through the first transfer region, supply of a first transfer bias is stopped (ON→OFF). Consequently, the entire region of the first yellow toner image is transferred to the intermediate transfer belt 20, which is rotated in the B direction, through a first transfer. In the first transfer of the first yellow toner image, the yellow toner remaining on the photosensitive drum 11 without being transferred to the intermediate transfer belt 20 reaches a portion facing the drum cleaning device 16 as the photosensitive drum 11 is rotated in the A direction, and is removed by the drum cleaning device 16. Then, the first rotation of the intermediate transfer belt 20 is ended, and the intermediate transfer belt 20 enters the second rotation.

With the yellow developing section 14Y kept stationary at the developing position, supply of a second yellow exposure signal y2 is started (OFF→ON). At this time, exposure data prepared for yellow, of the second exposure data prepared in step S50 of FIG. 5, are supplied as the second yellow exposure signal y2. Consequently, the photosensitive drum 11, which is rotated in the A direction in the state of being charged, is exposed to the exposure beam Bm output from the exposure device 13 in a portion for formation of a second yellow toner image. As a result, a second yellow electrostatic latent image is formed on the photosensitive drum 11.

Then, as the photosensitive drum 11 is rotated in the A direction, the second yellow electrostatic latent image formed on the photosensitive drum 11 passes through the developing region. At this time, a yellow toner is selectively transferred from the yellow developing section 14Y, which is disposed at the developing position, to the photosensitive drum 11. As a result, a second yellow toner image that matches the second yellow electrostatic latent image is developed on the photosensitive drum 11 which has passed through the developing region.

Next, as the distal end of the second yellow toner image formed on the photosensitive drum 11 reaches the first transfer region, supply of a first transfer bias is started (OFF→ON). Consequently, the second yellow toner image formed on the photosensitive drum 11 which is rotated in the A direction starts being transferred to the intermediate transfer belt 20, which is rotated in the B direction, through a first transfer. In the exemplary embodiment, supply of the second yellow exposure signal y2 is controlled such that the distal end of the second yellow toner image formed on the photosensitive drum 11 reaches the first transfer region when the distal end of the first yellow toner image which has already been transferred to the intermediate transfer belt 20 reaches the first transfer region. Therefore, the second yellow toner image is superposed on the first yellow toner image on the intermediate transfer belt 20 which has passed through the first transfer region.

In the example, after a first transfer of the second yellow toner image is started, supply of the second yellow exposure signal y2 is stopped (ON→OFF), and formation of the second yellow electrostatic latent image is ended. Then, as the rear end of the second yellow toner image formed on the photosensitive drum 11 passes through the first transfer region, supply of a first transfer bias is stopped (ON→OFF). Consequently, the entire region of the second yellow toner image is transferred to the intermediate transfer belt 20, which is rotated in the B direction, through a first transfer. In the first transfer of the second yellow toner image, the yellow toner remaining on the photosensitive drum 11 without being transferred to the intermediate transfer belt 20 reaches a portion facing the drum cleaning device 16 as the photosensitive drum 11 is rotated in the A direction, and is removed by the drum cleaning device 16. Then, the second rotation of the intermediate transfer belt 20 is ended, and the intermediate transfer belt 20 enters the third rotation.

After the second yellow electrostatic latent image passes through the developing region, drive of the rotary developing device 14 is started, and stopped with the magenta developing section 14M disposed at the developing position. After the magenta developing section 14M is stopped at the developing position, supply of a first magenta exposure signal m1 is started (OFF→ON). At this time, exposure data prepared for magenta, of the first exposure data prepared in step S50 illustrated in FIG. 5, are supplied as the magenta exposure signal m1. Consequently, the photosensitive drum 11, which is rotated in the A direction in the state of being charged, is exposed to the exposure beam Bm output from the exposure device 13 in a portion for formation of a first magenta toner image. As a result, a first magenta electrostatic latent image is formed on the photosensitive drum 11.

Then, as the photosensitive drum 11 is rotated in the A direction, the first magenta electrostatic latent image formed on the photosensitive drum 11 passes through the developing region. At this time, a magenta toner is selectively transferred from the magenta developing section 14M, which is disposed at the developing position, to the photosensitive drum 11. As a result, a first magenta toner image that matches the first magenta electrostatic latent image is developed on the photosensitive drum 11 which has passed through the developing region.

Next, as the distal end of the first magenta toner image formed on the photosensitive drum 11 reaches the first transfer region, supply of a first transfer bias is started (OFF→ON). Consequently, the first magenta toner image formed on the photosensitive drum 11 which is rotated in the A direction starts being transferred to the intermediate transfer belt 20, which is rotated in the B direction, through a first transfer. In the exemplary embodiment, supply of the first magenta exposure signal m1 is controlled such that the distal end of the first magenta toner image formed on the photosensitive drum 11 reaches the first transfer region when the distal end of the yellow toner images (the first yellow toner image and the second yellow toner image) which have already been transferred to the intermediate transfer belt 20 reaches the first transfer region. Therefore, the first magenta toner image is superposed on the yellow toner image on the intermediate transfer belt 20 which has passed through the first transfer region.

In the example, after a first transfer of the first magenta toner image is started, supply of the first magenta exposure signal m1 is stopped (ON→OFF), and formation of the first magenta electrostatic latent image is ended. Then, as the rear end of the first magenta toner image formed on the photosensitive drum 11 passes through the first transfer region, supply of a first transfer bias is stopped (ON→OFF). Consequently, the entire region of the first magenta toner image is transferred to the intermediate transfer belt 20, which is rotated in the B direction, through a first transfer. In the first transfer of the first magenta toner image, the magenta toner remaining on the photosensitive drum 11 without being transferred to the intermediate transfer belt 20 reaches a portion facing the drum cleaning device 16 as the photosensitive drum 11 is rotated in the A direction, and is removed by the drum cleaning device 16. Then, the third rotation of the intermediate transfer belt 20 is ended, and the intermediate transfer belt 20 enters the fourth rotation.

With the magenta developing section 14M kept stationary at the developing position, supply of a second magenta exposure signal m2 is started (OFF→ON). At this time, exposure data prepared for magenta, of the second exposure data prepared in step S50 of FIG. 5, are supplied as the second magenta exposure signal m2. Consequently, the photosensitive drum 11, which is rotated in the A direction in the state of being charged, is exposed to the exposure beam Bm output from the exposure device 13 in a portion for formation of a second magenta toner image. As a result, a second magenta electrostatic latent image is formed on the photosensitive drum 11.

Then, as the photosensitive drum 11 is rotated in the A direction, the second magenta electrostatic latent image formed on the photosensitive drum 11 passes through the developing region. At this time, a magenta toner is selectively transferred from the magenta developing section 14M, which is disposed at the developing position, to the photosensitive drum 11. As a result, a second magenta toner image that matches the second magenta electrostatic latent image is developed on the photosensitive drum 11 which has passed through the developing region.

Next, as the distal end of the second magenta toner image formed on the photosensitive drum 11 reaches the first transfer region, supply of a first transfer bias is started (OFF→ON). Consequently, the second magenta toner image formed on the photosensitive drum 11 which is rotated in the A direction starts being transferred to the intermediate transfer belt 20, which is rotated in the B direction, through a first transfer. In the exemplary embodiment, supply of the second magenta exposure signal m2 is controlled such that the distal end of the second magenta toner image formed on the photosensitive drum 11 reaches the first transfer region when the distal end of the yellow toner images and the first magenta toner image which have already been transferred to the intermediate transfer belt 20 reaches the first transfer region. Therefore, the second magenta toner image is superposed on the yellow toner images and the first magenta toner image on the intermediate transfer belt 20 which has passed through the first transfer region.

In the example, after a first transfer of the second magenta toner image is started, supply of the second magenta exposure signal m2 is stopped (ON→OFF), and formation of the second magenta electrostatic latent image is ended. Then, as the rear end of the second magenta toner image formed on the photosensitive drum 11 passes through the first transfer region, supply of a first transfer bias is stopped (ON→OFF). Consequently, the entire region of the second magenta toner image is transferred to the intermediate transfer belt 20, which is rotated in the B direction, through a first transfer. In the first transfer of the second magenta toner image, the magenta toner remaining on the photosensitive drum 11 without being transferred to the intermediate transfer belt 20 reaches a portion facing the drum cleaning device 16 as the photosensitive drum 11 is rotated in the A direction, and is removed by the drum cleaning device 16. Then, the fourth rotation of the intermediate transfer belt 20 is ended, and the intermediate transfer belt 20 enters the fifth rotation.

After that, through the same procedures, a first cyan toner image is formed on the intermediate transfer belt 20 in the fifth rotation (on the basis of a first cyan exposure signal c1), and a second cyan toner image is formed on the intermediate transfer belt 20 in the sixth rotation (on the basis of a second cyan exposure signal c2). Further subsequently, a first black toner image is formed on the intermediate transfer belt 20 in the seventh rotation (on the basis of a first black exposure signal k1), and a second black toner image is formed on the intermediate transfer belt 20 in the eighth rotation (on the basis of a second black exposure signal k2). As a result, yellow, magenta, cyan, and black toner images are superposed on each other on the intermediate transfer belt 20.

After the second black electrostatic latent image passes through the developing region, drive of the rotary developing device 14 is started, and stopped with none of the developing sections (14Y, 14M, 14C, and 14K) disposed at the developing position.

After the rear end of the superposed toner image of the yellow, magenta, and cyan toner images and the first black toner image held on the intermediate transfer belt 20 which is rotated in the B direction passes through a portion facing the belt cleaning device 27, and before the distal end of a superposed toner image of yellow, magenta, cyan, and black, which is obtained by further superposing a second black toner image on the superposed toner image through passage through the first transfer region thereafter, reaches the second transfer region, the second transfer roller 31 and the belt cleaning device 27 are moved (retracted→advanced) to a position at which the second transfer roller 31 and the belt cleaning device 27 contact the intermediate transfer belt 20. Then, as the distal end of the superposed toner image of yellow, magenta, cyan, and black held on the intermediate transfer belt 20 reaches the second transfer region, supply of a second transfer bias is started (OFF→ON). In the exemplary embodiment, transport of the sheet S is controlled such that the distal end of the sheet S reaches the second transfer region when the distal end of the superposed toner image of yellow, magenta, cyan, and black held on the intermediate transfer belt 20 reaches the second transfer region. Therefore, the superposed toner image is transferred from the intermediate transfer belt 20 to the sheet S through a second transfer in the second transfer region.

As the superposed toner image held on the intermediate transfer belt 20 and the sheet S pass through the second transfer region, supply of a second transfer bias is stopped (ON→OFF) to complete a second transfer of the superposed toner image to the sheet S. The superposed toner image on the sheet S which has passed through the second transfer region is fixed by the fixing device 50. In the second transfer of the superposed toner image, the toners in the various colors remaining on the intermediate transfer belt 20 without being transferred to the sheet S reaches a portion facing the belt cleaning device 27 as the intermediate transfer belt 20 is rotated in the B direction, and are removed by the drum cleaning device 27.

Then, after the rear end of the superposed toner image formation region on the intermediate transfer belt 20 passes through a portion facing the belt cleaning device 27, the second transfer roller 31 and the belt cleaning device 27 are moved (advanced→retracted) to a position away from the intermediate transfer belt 20. In addition, drive of the photosensitive drum 11 and the intermediate transfer belt 20 is stopped (ON→OFF), and supply of a charging bias is also stopped (ON→OFF).

Through the steps described above, formation of a full-color image on the single sheet S in the high quality mode is completed.

In this way, in the high quality mode according to the exemplary embodiment, the first yellow toner image is transferred to the intermediate transfer belt 20 in the first rotation of the intermediate transfer belt 20 through a first transfer, the second yellow toner image in the second rotation, the first magenta toner image in the third rotation, and the second magenta toner image in the fourth rotation. In the high quality mode according to the exemplary embodiment, in addition, the first cyan toner image is transferred to the intermediate transfer belt 20 in the fifth rotation of the intermediate transfer belt 20 through a first transfer, the second cyan toner image in the sixth rotation, the first black toner image in the seventh rotation, and the second black toner image in the eighth rotation. In the high quality mode according to the exemplary embodiment, then, the superposed toner image on the intermediate transfer belt 20 is transferred to the sheet S through a second transfer in the eighth rotation of the intermediate transfer belt 20.

Developing operation performed by the developing sections in the image forming operation in the normal quality mode and the high quality mode discussed above will be described in more detail.

In the description, the yellow developing section 14Y illustrated in FIG. 2 is disposed at the developing position facing the photosensitive drum 11, for example.

In the yellow developing section 14Y disposed at the developing position, the developing sleeve 42*a*, the first agitation/transport member 43, and the second agitation/transport member 44 are driven, and a developing bias is supplied to the developing sleeve 42*a*. Then, as the first agitation/transport member 43 and the second agitation/transport member 44 are rotated, the developer is agitated and transported in the developing housing 41. When the developer is agitated and transported, the toner and the carrier composing the developer are rubbed against each other so that the toner and the carrier are charged to a negative polarity and a positive polarity, respectively. As a result, in the developer which is agitated and transported, the toner is electrostatically adsorbed to the carrier. Then, when the developer which is agitated and transported is transported to a portion facing the developing roller 42, a part of the carrier is transferred to the developing roller 42 by a magnetic force that acts between the magnetic poles provided in the magnet roller 42*b* and the carrier contained in the developer. At this time, the toner has been electrostatically adsorbed to the carrier transferred to the developing roller 42. Therefore, as a result, the developer is transferred to the developing roller 42, and a developer layer made of the developer is formed on the outer peripheral surface of the developing sleeve 42*a*.

As the developing sleeve 42*a* is rotated in the D direction, the developer layer formed on the developing sleeve 42*a* is transported, and conveyed to the opening (developing region) of the developing housing 41 facing the photosensitive drum 11 with the thickness of the developer layer restricted to a thickness determined in advance when the developer layer passes through a portion facing the layer thickness restricting member 45. The developer scraped by the layer thickness restricting member 45 is returned to the first agitation/transport member 43 by the gravitational force.

The developer layer which has passed the portion facing the layer thickness restricting member 45 is transported as the developing sleeve 42*a* is rotated in the D direction, and reaches the developing region at which the photosensitive drum 11 and the developing sleeve 42*a* face each other. In the developing region, the toner is electrostatically transferred from the developer layer on the developing sleeve 42*a*, to which a developing bias is supplied, to the image portion (region at the exposure potential) on the photosensitive drum 11 to develop the electrostatic latent image into a visible image.

After that, the developer layer on the developing sleeve 42*a* which has passed through the developing region is returned into the developing housing 41 as the developing sleeve 42*a* is rotated in the D direction. Then, the developer layer on the developing sleeve 42*a* returned into the developing housing 41 is broken away from the developing roller 42 to fall down into the developing housing 41 because of a repulsive magnetic field formed by the magnetic poles provided in the magnet roller 42*b*, and agitated and transported by the first agitation/transport member 43 and the second agitation/transport member 44 again in preparation for next development.

Figure 8A:
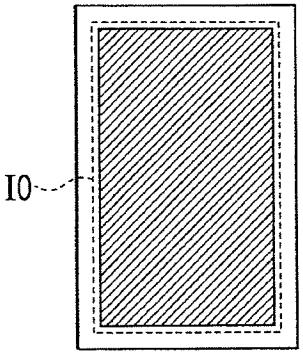
FIGS. 8A to 8F illustrate examples of various data and various toner images obtained in the high quality mode.
Figure 8B:
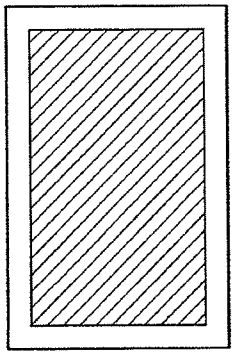
Figure 8C:
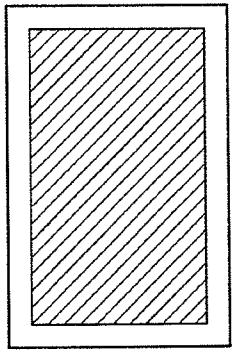
Figure 8D:
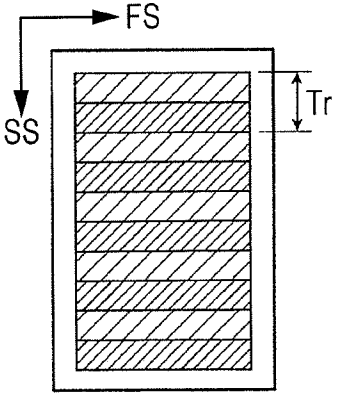
Figure 8E:
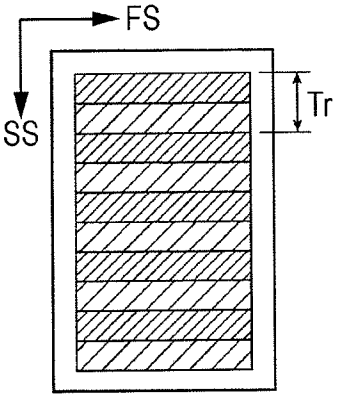
Figure 8F:
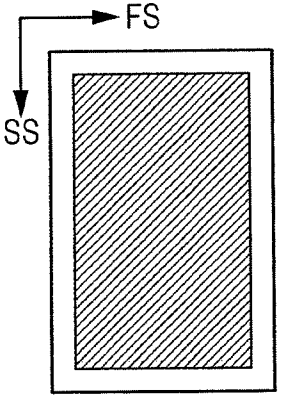

FIGS. 8A to 8F illustrate examples of various data and various toner images obtained in the high quality mode. FIG. 8A illustrates the print data acquired in step S20 of FIG. 5. FIGS. 8B and 8C illustrate the first exposure data and the second exposure data, respectively, prepared in step S50 of FIG. 5. FIG. 8D illustrates the first toner image formed on the intermediate transfer belt 20 on the basis of the first exposure data. FIG. 8E illustrates the second toner image formed on the intermediate transfer belt 20 on the basis of the second exposure data. FIG. 8F illustrates the superposed toner image obtained by superposing the first toner image and the second toner image on each other on the intermediate transfer belt 20. The same also applies to FIG. 10 to be discussed later.

As illustrated in FIG. 8A, the print data acquired in step S20 include a full halftone image I0 configured in black monochrome. In the example, the density of the full halftone image I0 is 50%.

In the case where the print data illustrated in FIG. 8A are acquired, the controller 60 analyzes the print data in step S40 illustrated in FIG. 5, and prepares first exposure data and second exposure data in step S50. In the example, the controller 60 prepares first exposure data and second exposure data by simply dividing the full halftone image I0 in the print data into two halves. Thus, as illustrated in FIGS. 8B and 8C, the first exposure data and the second exposure data each include full halftone data with a density of 25%.

After that, in step S60, the first exposure data and the second exposure data illustrated in FIGS. 8B and 8C, respectively, are used to perform printing in the high quality mode. In the example, a first black exposure signal k1 is obtained on the basis of the first exposure data illustrated in FIG. 8B, and a second black exposure signal k2 is obtained on the basis of the second exposure data illustrated in FIG. 8C.

At this time, as illustrated in FIG. 8D, the first toner image (first black toner image) obtained using the first exposure data (first black exposure signal k1) is cockled in density in the sub scanning direction SS. The cockle in density in the sub scanning direction SS in the first black toner image is ascribable to the eccentricity of the developing sleeve 42*a*. That is, even in the case where an image with a constant density (in the example, a halftone image with a density of 25%) is to be prepared, for example, the density of the developed toner image is reduced with the photosensitive drum 11 and the developing sleeve 42*a* located away from each other, and the density of the developed toner image is increased with the photosensitive drum 11 and the developing sleeve 42*a* close to each other. As a result, the first black toner image formed on the intermediate transfer belt 20 is cockled in density in the sub scanning direction SS in accordance with the roller rotation period Tr of the developing roller 42 (developing sleeve 42*a*).

In addition, as illustrated in FIG. 8E, the second toner image (second black toner image) obtained using the second exposure data (second black exposure signal k2) is also cockled in density in the sub scanning direction SS. The cockle in density in the sub scanning direction SS in the second black toner image is also ascribable to the eccentricity of the developing sleeve 42*a*. It should be noted, however, that in the image forming apparatus according to the exemplary embodiment, as described with reference to FIG. 4, the roller rotation period Tr of the developing roller 42 (developing sleeve 42*a*) and the belt rotation period Tb of the intermediate transfer belt 20 are set to meet the relation Tb=14.5Tr. Therefore, the position of the developing sleeve 42*a* is inverted by 180° between when development of the first black toner image is started and when development of the second black toner image is started. As a result, the second black toner image formed on the intermediate transfer belt 20 is cockled in density in the sub scanning direction SS in accordance with the roller rotation period Tr of the developing roller 42 (developing sleeve 42*a*) and with the density inverted with respect to the first black toner image.

Thus, in the superposed toner image (black superposed toner image) obtained by superposing the first black toner image and the second black toner image on each other on the intermediate transfer belt 20, as illustrated in FIG. 8F, the cockle in density in the first black toner image in the sub scanning direction SS and the cockle in density in the second black toner image in the sub scanning direction SS are canceled out by each other. In addition, the obtained black superposed toner image has a density of close to 50% which is the goal.

Figure 9:
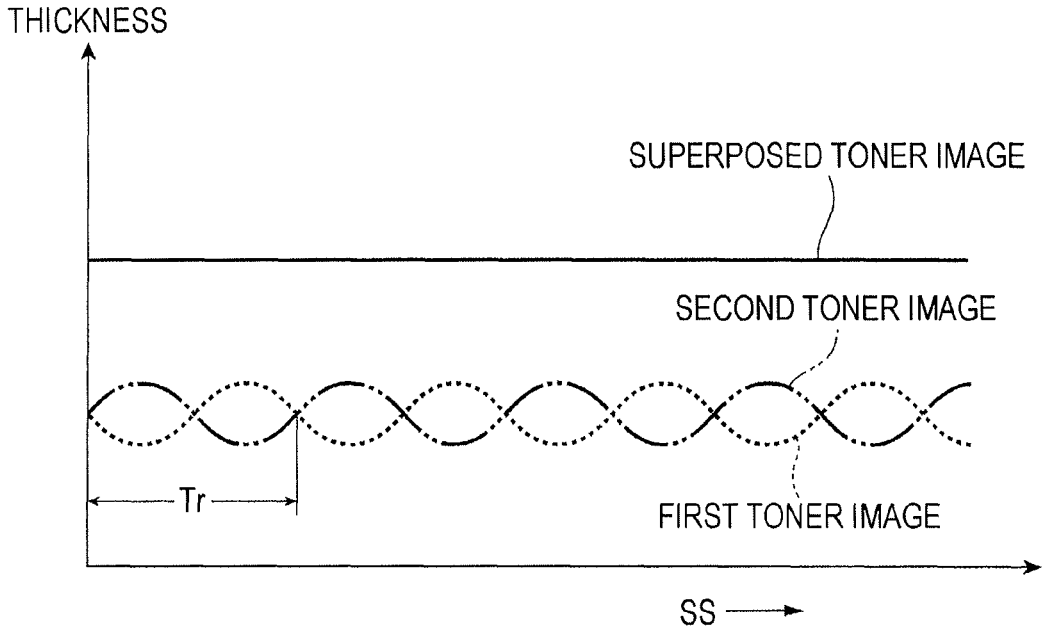
FIG. 9 illustrates the relationship in density among a first toner image, a second toner image, and a superposed toner image in the image forming operation in the high quality mode illustrated in FIG. 8.

FIG. 9 illustrates the relationship in density among a first toner image (first black toner image), a second toner image (second black toner image), and a superposed toner image (black superposed toner image) in the high quality mode illustrated in FIGS. 8A to 8F. In FIG. 9, the horizontal axis indicates the distance in the sub scanning direction SS, and the vertical axis indicates the density of the toner images.

As discussed above, a cockle in density in a sinusoidal shape that is ascribable to the eccentricity of the developing sleeve 42*a* is generated in the first black toner image which is formed on the intermediate transfer belt 20 on the basis of the first black exposure signal k1 obtained in correspondence with a halftone image with a density of 25%. In addition, a cockle in density in a sinusoidal shape that is ascribable to the eccentricity of the developing sleeve 42*a* is also generated in the second black toner image which is formed on the basis of the second black exposure signal k2 also obtained in correspondence with the halftone image with a density of 25%. It should be noted, however, that there is a deviation of 180° between the position of the developing sleeve 42*a* during development of the first black toner image and the position of the developing sleeve 42*a* during development of the second black toner image, and thus the cockle in density in the first black toner image and the cockle in density in the second black toner image are inverted with respect to each other. Therefore, it is understood that the cockles in density in the sub scanning direction SS cancel out each other in the black superposed toner image obtained by superposing the first black toner image and the second black toner image on each other on the intermediate transfer belt 20.

In the high quality mode, when compared to the normal quality mode, non-uniformity in density in the sub scanning direction SS may be suppressed, but the productivity in image formation is reduced in accordance with an increase in rotational speed of the intermediate transfer belt 20 required for the image formation. In contrast, in the normal quality mode, when compared to the high quality mode, the productivity in image formation may be improved in accordance with a reduction in rotational speed of the intermediate transfer belt 20 required for the image formation, but non-uniformity in density in the sub scanning direction SS may be generated.

In the example illustrated in FIGS. 8A to 8F, the first exposure data and the second exposure data are prepared by simply dividing the acquired print data into two halves. However, the present invention is not limited thereto.

FIGS. 10A to 10F illustrate other examples of various data and various toner images obtained in the high quality mode.

Figure 10A:
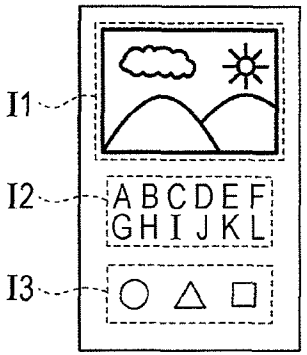
FIGS. 10A to 10F illustrate other examples of various data and various toner images obtained in the high quality mode.

As illustrated in FIG. 10A, the print data acquired in step S20 include a photographic image I1 (an example of a photographic image portion) constituted of a photograph, a textual image I2 (an example of a character image portion) constituted of characters (in the example, alphabets), and a line image I3 (an example of a line image portion) constituted of various line images (in the example, a circle, a triangle, and a square). In the example, the photographic image I1 is constituted of raster data (bit-map data), for example, and the textual image I2 and the line image I3 are constituted of vector data. In the example, in addition, the photographic image I1, the textual image I2, and the line image I3 are all configured in black monochrome.

In the example, the photographic image I1 is mentioned as an example of the photographic image portion. However, the present invention is not limited thereto. For example, an illustration or a halftone background portion may be used as the photographic image portion. A binary image (black-and-white image) expressed in binary values may be used as the character image portion or the line image portion, and a multi-level image (grayscale image) expressed in multiple values of three values or more may be used as the photographic image portion.

Figure 10B:
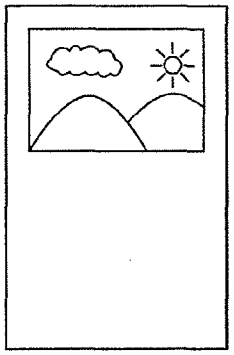
Figure 10C:
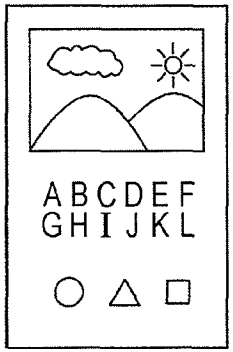

In the case where the print data illustrated in FIG. 10A are acquired, the controller 60 analyzes the print data in step S40 illustrated in FIG. 5, and prepares first exposure data and second exposure data in step S50. In the example, the controller 60 prepares first exposure data and second exposure data by simply dividing the photographic image I1, of the print data, into two halves without dividing the textual image I2 and the line image I3. Thus, as illustrated in FIG. 10B, the first exposure data include data obtained by reducing the density of the photographic image I1 to half the original. In contrast, as illustrated in FIG. 10C, the second exposure data include data obtained by reducing the density of the photographic image I1 to half the original, data corresponding to the textual image I2, and data corresponding to the line image I3.

After that, in step S60, the first exposure data and the second exposure data illustrated in FIGS. 10B and 100, respectively, are used to perform printing in the high quality mode. In the example, a first black exposure signal k1 is obtained on the basis of the first exposure data illustrated in FIG. 10B, and a second black exposure signal k2 is obtained on the basis of the second exposure data illustrated in FIG. 100.

Figure 10D:
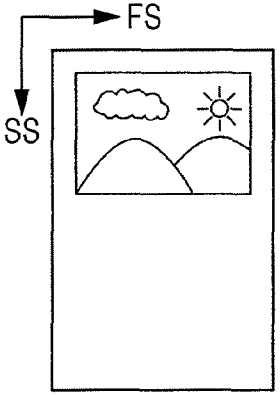

At this time, as illustrated in FIG. 10D, the first toner image (first black toner image) obtained using the first exposure data (first black exposure signal k1) includes the photographic image I1 set to half the original density. In the example, although not indicated in FIG. 10D, the first black toner image is cockled in density in the sub scanning direction SS as with the first black toner image illustrated in FIG. 8D. As a result, the first black toner image formed on the intermediate transfer belt 20 is cockled in density in the sub scanning direction SS in accordance with the roller rotation period Tr of the developing roller 42 (developing sleeve 42*a*).

Figure 10E:
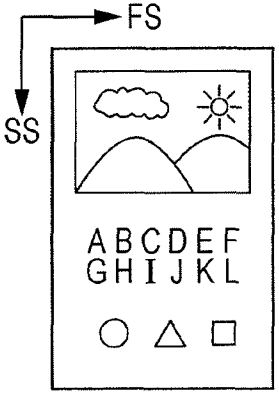

In addition, as illustrated in FIG. 10E, the second toner image (second black toner image) obtained using the second exposure data (second black exposure signal k2) includes the photographic image I1 set to half the original density and the textual image I2 and the line image I3 set to the original density. In the example, although not indicated in FIG. 10E, the second black toner image is cockled in density in the sub scanning direction SS as with the second black toner image illustrated in FIG. 8E. As a result, the second black toner image formed on the intermediate transfer belt 20 is cockled in density in the sub scanning direction SS in accordance with the roller rotation period Tr of the developing roller 42 (developing sleeve 42*a*) and with the density inverted with respect to the first black toner image.

Figure 10F:
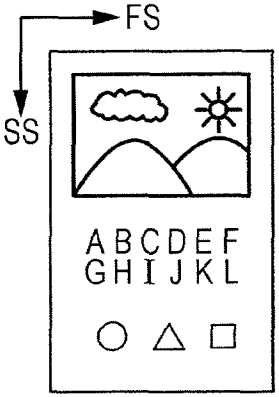

Thus, in the superposed toner image (black superposed toner image) obtained by superposing the first black toner image and the second black toner image on each other on the intermediate transfer belt 20, as illustrated in FIG. 10F, the cockle in density in the first black toner image in the sub scanning direction SS and the cockle in density in the second black toner image in the sub scanning direction SS are canceled out by each other for the toner image corresponding to the photographic image I1. In the black superposed toner image illustrated in FIG. 10F, in contrast, the cockle in density in the sub scanning direction SS may be present for the toner images corresponding to the textual image I2 and the line image I3. It should be noted, however, that the textual image I2 and the line image I3 are often solid images, and therefore the cockle in the sub scanning direction SS is inconspicuous. In the case where the textual image I2 and the line image I3 are each divided into two halves and distributed to the first black exposure data and the second black exposure data, a blur generated in the black toner image obtained by superposing the first black toner image and the second black toner image on each other on the intermediate transfer belt 20 may be conspicuous in the case where a misregistration is generated in the principal scanning direction FS or the sub scanning direction SS during a first transfer etc. For such a reason, in the example illustrated in FIGS. 10A to 10F, the textual image I2 and the line image I3 are distributed to the second exposure data alone while the photographic image I1 is distributed to both the first exposure data and the second exposure data.

The textual image I2 and the line image I3 are distributed to the second exposure data, rather than to the first exposure data, for the following reason.

In the high quality mode according to the exemplary embodiment, toner images are transferred to the intermediate transfer belt 20 through a first transfer, twice for each color. For example, for black, a first black toner image is transferred to the intermediate transfer belt 20 through a first transfer, and thereafter a second black toner image is transferred, as superposed on the first black toner image on the intermediate transfer belt 20, through a first transfer. In the case where the textual image I2 and the line image I3 are distributed to the first exposure data, the first black toner image (including the textual image I2 and the line image I3) which has been transferred onto the intermediate transfer belt 20 through a first transfer passes through the first transfer region during a first transfer of the second black toner image. During passage through the first transfer region for a first transfer of the second black toner image, the first black toner image on the intermediate transfer belt 20 may be inversely transferred to the photosensitive drum 11, which may reduce the density of the resulting black toner image. In the case where the textual image I2 and the line image I3 are distributed to the second exposure data, in contrast, there is no such possibility. Thus, in the exemplary embodiment, the textual image I2 and the line image I3 are distributed to the second exposure data, rather than to the first exposure data. It should be noted, however, that the present invention is not limited thereto, and the textual image I2 and the line image I3 may be distributed to the first exposure data.

In the example illustrated in FIGS. 8A to 8F, 9, and 10A to 10F, a black monochrome toner image is formed. However, the present invention is not limited thereto. That is, the present invention may also be applied to a case where a full-color toner image including yellow, magenta, cyan, and black is to be formed.

In the exemplary embodiment, in the high quality mode, image formation is performed in the order of a first yellow toner image, a second yellow toner image, a first magenta toner image, a second magenta toner image, a first cyan toner image, a second cyan toner image, a first black toner image, and a second black toner image. However, the present invention is not limited thereto. For example, image formation may be performed in the order of a first yellow toner image, a first magenta toner image, a first cyan toner image, a first black toner image, a second yellow toner image, a second magenta toner image, a second cyan toner image, and a second black toner image. Moreover, the order of formation for yellow, magenta, cyan, and black may also be changed.

In the exemplary embodiment, in the high quality mode, two exposure data (first exposure data and second exposure data) are prepared on the basis of the acquired print data, and two toner images are formed for each color. However, the present invention is not limited thereto. For example, four exposure data (first exposure data to fourth exposure data) may be prepared on the basis of the acquired print data, and four toner images may be formed for each color.

Second Exemplary Embodiment

Figure 11:
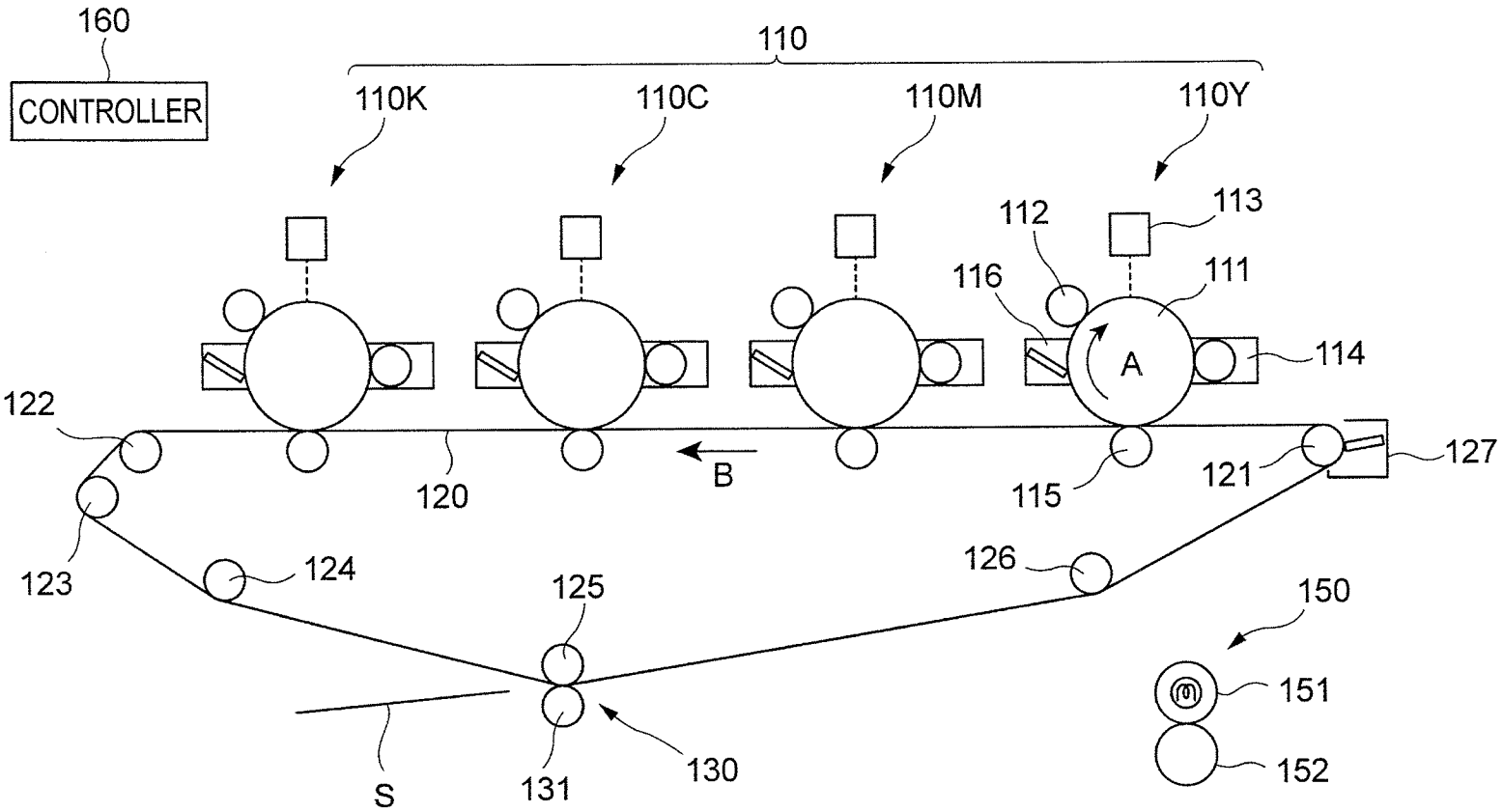
FIG. 11 illustrates a schematic configuration of an image forming apparatus according to a second exemplary embodiment.

FIG. 11 illustrates a schematic configuration of an image forming apparatus according to a second exemplary embodiment.

The image forming apparatus includes plural (in the exemplary embodiment, four) image forming units 110

(specifically, 110Y, 110M, 110C, and 110K) and an intermediate transfer belt 120. The image forming units 110 form toner images in each color using an electrophotographic method, for example. The toner images in each color, which have been formed by the image forming units 110, are transferred (first transfer) to the intermediate transfer belt 120 to be held thereon. The image forming apparatus also includes a second transfer portion 130, a fixing device 150, and a controller 160. The second transfer portion 130 transfers a superposed toner image, which has been transferred to the intermediate transfer belt 120 through a first transfer, to paper through a second transfer. The fixing device 150 fixes the image, which has been transferred through a second transfer, onto the paper. The controller 160 controls operation of various portions composing the image forming apparatus.

The image forming units 110, that is, the yellow (Y) image forming unit 110Y, the magenta (M) image forming unit 110M, the cyan (C) image forming unit 110C, and the black (K) image forming unit 110K, are the same in configuration as each other except for the color of the toner used thereby. Thus, a description will be made using the yellow image forming unit 110Y as an example.

The yellow image forming unit 110Y includes a photosensitive drum 111 provided so as to be rotatable in the A direction. The yellow image forming unit 110Y also includes a charging roller 112, an exposure device 113, a developing section 114, a first transfer roller 115, and a drum cleaning device 116, which are provided around the photosensitive drum 111 along the A direction.

The photosensitive drum 111, the charging roller 112, the exposure device 113, the developing section 114, the first transfer roller 115, and the drum cleaning device 116 are the same in configuration as the photosensitive drum 11, the charging roller 12, the exposure device 13, the developing section (e.g. the yellow developing section 14Y; see FIG. 2), the first transfer roller 15, and the drum cleaning device 16, respectively, described in relation to the first exemplary embodiment.

The intermediate transfer belt 120 is rotatably wound around plural (in the second exemplary embodiment, six) rollers 121 to 126. Among the plural rollers, the driving roller 121 applies a tension to the intermediate transfer belt 120, and rotationally drives the intermediate transfer belt 120 in the B direction. The driven rollers 122, 123, and 126 apply a tension to the intermediate transfer belt 120, and are rotationally driven by the intermediate transfer belt 120 which is driven by the driving roller 121. The correction roller 124 applies a tension to the intermediate transfer belt 120, and functions as a steering roller that restricts meandering of the intermediate transfer belt 120 in the width direction which intersects the transport direction. The back-up roller 125 applies a tension to the intermediate transfer belt 120, and functions as a constituent member of the second transfer portion 130 to be discussed later. A belt cleaning device 127 is disposed at a portion facing the driving roller 121 across the intermediate transfer belt 120. The belt cleaning device 127 removes attached matter (such as a toner) on the intermediate transfer belt 120 after the second transfer.

The second transfer portion 130 includes a second transfer roller 131 and the back-up roller 125. The second transfer roller 131 is disposed in contact with a toner image transfer surface of the intermediate transfer belt 120. The back-up roller 125 is disposed on the back surface of the intermediate transfer belt 120 to serve as a counter electrode for the second transfer roller 131.

In the exemplary embodiment, the second transfer roller 131 composing the second transfer portion 130 is advanceable and retractable to and from the intermediate transfer belt 120. This allows the second transfer roller 131 to be brought into and out of contact with the intermediate transfer belt 120.

In the exemplary embodiment, in addition, the belt cleaning device 127 is also advanceable and retractable to and from the intermediate transfer belt 120. This allows the belt cleaning device 127 to be brought into and out of contact with the intermediate transfer belt 120.

Further, the fixing device 150 includes a heating roller 151 and a pressurizing roller 152. The heating roller 151 and the pressurizing roller 152 are common to the heating roller 51 and the pressurizing roller 52 described in relation to the first exemplary embodiment.

A control system for the image forming apparatus according to the exemplary embodiment is basically the same as that described in relation to the first exemplary embodiment (see FIG. 3). It should be noted, however, that the image forming apparatus according to the exemplary embodiment does not include the rotary developing device 14, and thus is not provided with the developing device drive motor 84.

In the exemplary embodiment, in addition, the roller rotation period Tr, which is the rotational period of a developing sleeve of a developing roller (the developing sleeve 42*a* of the developing roller 42 illustrated in FIG. 2) provided to the developing section 114 of each image forming unit 110, and the belt rotation period Tb, which is the rotational period of the intermediate transfer belt 120, are set so as to meet the relation $Tb=40.5Tr$. That is, also in the image forming apparatus, the belt rotation period Tb and the roller rotation period Tr meet the relation $Tb=(n+0.5)\times Tr$ (n is a positive integer).

Also in the image forming apparatus according to the exemplary embodiment, further, as in the first exemplary embodiment, image forming operation may be performed in the normal quality mode and the high quality mode, and the normal quality mode and the high quality mode are set and executed in accordance with the flowchart illustrated in FIG. 5.

Next, the image forming operation in each image quality mode discussed above will be specifically described. In the example, the image forming apparatus illustrated in FIG. 11 is used to form a full-color image with four colors including yellow, magenta, cyan, and black on a single sheet S. In the initial state, the second transfer roller 131 and the belt cleaning device 127 are located away from the intermediate transfer belt 120.

The procedures of image forming operation in the normal quality mode will be described.

In the yellow image forming unit 110Y, the photosensitive drum 111 which is rotated in the direction of the arrow A is charged to a charging potential by a charging bias supplied to the charging roller 112. Next, exposure performed by the exposure device 113 is started, and the photosensitive drum 111, which is rotated in the A direction in the state of being charged to a charging potential, is exposed to light emitted from the exposure device 113 selectively in an image portion. At this time, exposure data prepared for yellow, of the exposure data prepared in step S70 of FIG. 5, are supplied as the yellow exposure signal. As a result, a yellow electrostatic latent image is formed on the photosensitive drum 111, which has been charged and exposed to light, with a region at the charging potential constituting a background portion and with a region at the exposure potential constituting an image portion.

Subsequently, as the photosensitive drum 111 is rotated in the A direction, the yellow electrostatic latent image formed on the photosensitive drum 111 passes through the developing region facing the developing section 114. At this time, a yellow toner is selectively transferred from the developing section 114 to the image portion, at the exposure potential, of the photosensitive drum 111. As a result, a yellow toner image that matches the yellow electrostatic latent image is developed on the photosensitive drum 111 which has passed through the developing region.

Next, as the photosensitive drum 111 is rotated in the A direction, the yellow toner image developed on the photosensitive drum 111 reaches the first transfer region facing the first transfer roller 115 across the intermediate transfer belt 120. At this time, with a first transfer bias supplied to the first transfer roller 115, the yellow toner image formed on the photosensitive drum 111 which is rotated in the A direction is transferred onto the intermediate transfer belt 120, which is rotated in the direction of the arrow B, through a first transfer (electrostatic transfer). Attached matter such as a toner remaining on the photosensitive drum 111 after the first transfer reaches a portion facing the drum cleaning device 116 as the photosensitive drum 11 is further rotated in the A direction, and is removed by the drum cleaning device 116.

Also in the other image forming units 110, namely the magenta image forming unit 110M, the cyan image forming unit 110C, and the black image forming unit 110K, charging, exposure, development, a first transfer, and cleaning are performed as in the yellow image forming unit 110Y. At this time, of the exposure data prepared in step S70 of FIG. 5, exposure data prepared for magenta are supplied as the magenta exposure signal, exposure data prepared for cyan are supplied as the cyan exposure signal, and exposure data prepared for black are supplied as the black exposure signal. Then, by shifting the timings for image formation, a superposed toner image obtained by superposing the yellow, magenta, cyan, and black toner images on each other is formed on the intermediate transfer belt 120.

As the intermediate transfer belt 120 is rotated in the B direction, the superposed toner image, which has been transferred onto the intermediate transfer belt 120 through a first transfer in this way, is directed to the second transfer region in which the second transfer roller 131 and the back-up roller 125 face each other across the intermediate transfer belt 120. Before the superposed toner image on the intermediate transfer belt 120 reaches the second transfer region, the second transfer roller 131 and the belt cleaning device 127 are moved to a position at which the second transfer roller 131 and the belt cleaning device 127 contact the intermediate transfer belt 120.

Meanwhile, the sheet S is transported to the second transfer region in accordance with the timing when the superposed toner image on the intermediate transfer belt 120 reaches the second transfer region.

At this time, a second transfer bias is supplied to the back-up roller 125 composing the second transfer portion 130. Then, in the second transfer region, the superposed toner image on the intermediate transfer belt 120 is transferred to the sheet S through a second transfer (electrostatic transfer) by the action of a second transfer electric field formed between the second transfer roller 131 and the back-up roller 125.

After that, the sheet S, to which the superposed toner image has been transferred through a second transfer, is transported to the fixing device 150, and the superposed toner image on the sheet S is fixed by the fixing device 150. Attached matter such as a toner remaining on the intermediate transfer belt 120 after the second transfer reaches a cleaning region facing the belt cleaning device 127 as the intermediate transfer belt 120 is further rotated in the B direction, and is removed by the belt cleaning device 127.

Through the steps described above, formation of a full-color image on the single sheet S in the normal quality mode is completed.

In this way, in the normal quality mode according to the exemplary embodiment, the superposed toner image including the yellow toner image, the magenta toner image, the cyan toner image, and the black toner image is transferred to the intermediate transfer belt 20 through a first transfer in the first rotation of the intermediate transfer belt 120. In the normal quality mode according to the exemplary embodiment, in addition, the superposed toner image on the intermediate transfer belt 120 is transferred to the sheet S through a second transfer in the first rotation of the intermediate transfer belt 120.

Next, the procedures of image forming operation in the high quality mode will be described.

In the yellow image forming unit 110Y, the photosensitive drum 111 which is rotated in the direction of the arrow A is charged by the charging roller 112. Next, exposure performed by the exposure device 113 is started, and the photosensitive drum 111, which is rotated in the A direction in the state of being charged, is exposed to light emitted from the exposure device 113 selectively in an image portion. At this time, exposure data prepared for yellow, of the first exposure data prepared in step S50 of FIG. 5, are supplied as the first yellow exposure signal. As a result, a first yellow electrostatic latent image is formed on the photosensitive drum 111 which has been charged and exposed.

Subsequently, as the photosensitive drum 111 is rotated in the A direction, the first yellow electrostatic latent image formed on the photosensitive drum 111 passes through the developing region facing the developing section 114. Then, a first yellow toner image that matches the first yellow electrostatic latent image is developed on the photosensitive drum 111 which has passed through the developing region.

Next, as the photosensitive drum 111 is rotated in the A direction, the first yellow toner image developed on the photosensitive drum 111 reaches the first transfer region. At this time, with a first transfer bias supplied to the first transfer roller 115, the first yellow toner image formed on the photosensitive drum 111 which is rotated in the A direction is transferred onto the intermediate transfer belt 120, which is rotated in the direction of the arrow B, through a first transfer (electrostatic transfer). Attached matter such as a toner remaining on the photosensitive drum 111 after the first transfer is removed by the drum cleaning device 116.

Also in the other image forming units 110, namely the magenta image forming unit 110M, the cyan image forming unit 110C, and the black image forming unit 110K, charging, exposure, development, a first transfer, and cleaning are performed as in the yellow image forming unit 110Y. At this time, of the first exposure data prepared in step S50 of FIG. 5, first exposure data prepared for magenta are supplied as the first magenta exposure signal, first exposure data prepared for cyan are supplied as the first cyan exposure signal, and first exposure data prepared for black are supplied as the first black exposure signal. Then, by shifting the timings for image formation, a superposed toner image (first superposed toner image) obtained by superposing the first yellow toner image, the first magenta toner image, the first cyan toner image, and the first black toner image on each other is formed on the intermediate transfer belt 120.

As the intermediate transfer belt 120 is rotated in the B direction, the superposed toner image, which has been transferred onto the intermediate transfer belt 120 through a first transfer in this way, is directed to the second transfer region in which the second transfer roller 131 and the back-up roller 125 face each other across the intermediate transfer belt 120. It should be noted, however, that in the high quality mode, unlike the normal quality mode discussed above, the second transfer roller 131 and the belt cleaning device 127 are kept at a position away from the intermediate transfer belt 120 while the first superposed toner image on the intermediate transfer belt 120 passes through the second transfer region and the cleaning region facing the belt cleaning device 127. Accordingly, the first superposed toner image formed on the intermediate transfer belt 120 is directed to the first transfer region again.

In the yellow image forming unit 110Y, meanwhile, the photosensitive drum 111 which is rotated in the direction of the arrow A is charged by the charging roller 112. Next, exposure performed by the exposure device 113 is started, and the photosensitive drum 111, which is rotated in the A direction in the state of being charged, is exposed to light emitted from the exposure device 113 selectively in an image portion. At this time, exposure data prepared for yellow, of the second exposure data prepared in step S50 of FIG. 5, are supplied as the second yellow exposure signal. As a result, a second yellow electrostatic latent image is formed on the photosensitive drum 111 which has been charged and exposed.

Subsequently, as the photosensitive drum 111 is rotated in the A direction, the second yellow electrostatic latent image formed on the photosensitive drum 111 passes through the developing region facing the developing section 114. Then, a second yellow toner image that matches the second yellow electrostatic latent image is developed on the photosensitive drum 111 which has passed through the developing region.

Next, as the photosensitive drum 111 is rotated in the A direction, the second yellow toner image developed on the photosensitive drum 111 reaches the first transfer region. At this time, with a first transfer bias supplied to the first transfer roller 115, the second yellow toner image formed on the photosensitive drum 111 which is rotated in the A direction is transferred onto the intermediate transfer belt 120, which is rotated in the direction of the arrow B, through a first transfer (electrostatic transfer). Attached matter such as a toner remaining on the photosensitive drum 111 after the first transfer is removed by the drum cleaning device 116.

Also in the other image forming units 110, namely the magenta image forming unit 110M, the cyan image forming unit 110C, and the black image forming unit 110K, charging, exposure, development, a first transfer, and cleaning are performed as in the yellow image forming unit 110Y. At this time, of the second exposure data prepared in step S50 of FIG. 5, second exposure data prepared for magenta are supplied as the second magenta exposure signal, second exposure data prepared for cyan are supplied as the second cyan exposure signal, and second exposure data prepared for black are supplied as the second black exposure signal. Then, by shifting the timings for image formation, a superposed toner image (second superposed toner image) obtained by superposing the second yellow toner image, the second magenta toner image, the second cyan toner image, and the second black toner image on the first superposed toner image is formed on the first superposed toner image, which has already been transferred through a first transfer, on the intermediate transfer belt 120. As a result, a superposed toner image obtained by superposing the first superposed toner image and the second superposed toner image is formed on the intermediate transfer belt 120.

As the intermediate transfer belt 120 is rotated in the B direction, the superposed toner image, which has been transferred onto the intermediate transfer belt 20 through a first transfer in this way, is directed to the second transfer region. Before the superposed toner image on the intermediate transfer belt 120 reaches the second transfer region, the second transfer roller 131 and the belt cleaning device 127 are moved to a position at which the second transfer roller 131 and the belt cleaning device 127 contact the intermediate transfer belt 120.

Meanwhile, the sheet S is transported to the second transfer region in accordance with the timing when the superposed toner image on the intermediate transfer belt 120 reaches the second transfer region.

Then, in the second transfer region, the superposed toner image on the intermediate transfer belt 120 is transferred to the sheet S through a second transfer (electrostatic transfer) by the action of a second transfer electric field formed between the second transfer roller 131 and the back-up roller 125.

After that, the sheet S, to which the superposed toner image has been transferred through a second transfer, is transported to the fixing device 150, and the superposed toner image on the sheet S is fixed by the fixing device 150. Attached matter such as a toner remaining on the intermediate transfer belt 120 after the second transfer reaches a cleaning region as the intermediate transfer belt 120 is further rotated in the B direction, and is removed by the belt cleaning device 127.

Through the steps described above, formation of a full-color image on the single sheet S in the high quality mode is completed.

In this way, in the high quality mode according to the exemplary embodiment, the first superposed toner image including the first yellow toner image, the first magenta toner image, the first cyan toner image, and the first black toner image is transferred to the intermediate transfer belt 20 through a first transfer in the first rotation of the intermediate transfer belt 120. In the high quality mode according to the exemplary embodiment, in addition, the second superposed toner image including the second yellow toner image, the second magenta toner image, the second cyan toner image, and the second black toner image is transferred to the intermediate transfer belt 20 through a second transfer in the second rotation of the intermediate transfer belt 120, and a superposed toner image obtained by superposing the first superposed toner image and the second superposed toner image on each other is formed on the intermediate transfer belt 120. In the high quality mode according to the exemplary embodiment, then, the superposed toner image on the intermediate transfer belt 120 is transferred to the sheet S through a second transfer in the second rotation of the intermediate transfer belt 120.

In the first and second exemplary embodiments, in the image forming apparatus which forms an image using the developing sleeve 42*a* (an example of a rotating member), when an image is formed on the intermediate transfer belt 20 (an example of an identical medium) separately in plural times (e.g. twice) on the basis of the input print data (an example of a single plate), the controller 60 performs control such that the phases of the developing sleeve 42*a* with respect to the plate reference position P during image formation with each plate for the plural times are inverted) (180°) with respect to each other.

In the first and second exemplary embodiments, the developing sleeve drive motor 85 which rotationally drives the developing sleeve 42*a* and the intermediate transfer belt drive motor 88 which rotates the intermediate transfer belt 20 (intermediate transfer belt 120) are provided. However, the present invention is not limited thereto. For example, the developing sleeve 42*a* and the intermediate transfer belt 20 (intermediate transfer belt 120) may be driven by a common motor.

In the first and second exemplary embodiments, the image forming apparatus with four colors is used. However, the present invention is not limited thereto. That is, the configuration discussed above may be applied to an image forming apparatus with three colors or less, which includes a monochrome image forming apparatus, or an image forming apparatus with five colors or more.

In the first and second exemplary embodiments, the first rotating member (rotating member) is applied to the developing sleeve 42*a*, and the second rotating member (identical medium) is applied to the intermediate transfer belt 20 (intermediate transfer belt 120). However, the present invention is not limited thereto.

For example, the present invention may also be applied to a case where the first rotating member (rotating member) is implemented by the photosensitive drum 11 (photosensitive drum 111), and the second rotating member (identical medium) is implemented by the intermediate transfer belt 20 (intermediate transfer belt 120). In addition, the present invention may also be applied to a case where the first rotating member (rotating member) is implemented by the driving roller 24 (driving roller 121), and the second rotating member (identical medium) is implemented by the intermediate transfer belt 20 (intermediate transfer belt 120). Further, the present invention may also be applied to a case where the first rotating member (rotating member) is implemented by the charging roller 12 (charging roller 112), and the second rotating member (identical medium) is implemented by the intermediate transfer belt 20 (intermediate transfer belt 120). Furthermore, the present invention may also be applied to a case where the first rotating member (rotating member) is implemented by the first transfer roller 15 (first transfer roller 115), and the second rotating member (identical medium) is implemented by the intermediate transfer belt 20 (intermediate transfer belt 120).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first rotating member that rotates at a first period T1;

a second rotating member that rotates at a second period T2;

a setting unit that sets the first period T1 and the second period T2 so that the first period T1 and the second period T2 meet a relation T2=(n+0.5)×T1 (n is a positive integer);

an image forming unit that:

forms a first image on the second rotating member in an x-th rotation (x is a positive integer) using first data obtained from print data and using the first rotating member; and forms a second image on the second rotating member in an (x+y)-th rotation (y is an odd positive integer) using second data obtained from the print data and using the first rotating member.

2. The image forming apparatus according to claim 1, further comprising:

a preparation unit that prepares the first data and the second data by dividing the print data into two halves with half an original density.

3. The image forming apparatus according to claim 1, further comprising:

a distribution unit that distributes a photographic image portion composing the print data to the first data and the second data by dividing the photographic image portion into two halves with half an original density, and that distributes a character image portion and a line image portion composing the print data to one of the first data and the second data without dividing such portions in terms of density.

4. An image forming apparatus comprising:

a photosensitive drum that is rotatable;

a latent image forming unit that forms an electrostatic latent image on the photosensitive drum;

a developing unit that includes a developer holding element that holds a developer and that rotates at a first period T1, the developing unit developing the electrostatic latent image formed on the photosensitive drum using the developer;

a transfer element that rotates at a second period T2; and a transfer unit that transfers an image developed on the photosensitive drum to the transfer element, wherein the first period T1 and the second period T2 are set so that the first period T1 and the second period T2 meet a relation T2=(n+0.5)×T1 (n is a positive integer), and first data obtained from print data are supplied to the latent image forming unit in an x-th rotation (x is a positive integer) of the transfer element, and second data obtained from the print data are supplied to the latent image forming unit in an (x+y)-th rotation (y is an odd positive integer) of the transfer element.

* * * * *